US007924298B2

(12) United States Patent
Uchida et al.

(10) Patent No.: US 7,924,298 B2
(45) Date of Patent: Apr. 12, 2011

(54) DISPLAY CONTROL METHOD, DRIVING DEVICE FOR DISPLAY DEVICE, DISPLAY DEVICE, PROGRAM, AND STORAGE MEDIUM

(75) Inventors: Toshihisa Uchida, Suzuka (JP); Makoto Shiomi, Tenri (JP); Kazunari Tomizawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 869 days.

(21) Appl. No.: 11/661,809

(22) PCT Filed: Sep. 1, 2005

(86) PCT No.: PCT/JP2005/016041

§ 371 (c)(1),
(2), (4) Date: Sep. 24, 2007

(87) PCT Pub. No.: WO2006/025506

PCT Pub. Date: Mar. 9, 2006

(65) Prior Publication Data

US 2008/0062163 A1 Mar. 13, 2008

(30) Foreign Application Priority Data

Sep. 3, 2004 (JP) ..... 2004-257630

(51) Int. Cl.
*G09G 5/10* (2006.01)
*G09G 3/36* (2006.01)

(52) U.S. Cl. ..... 345/690; 345/89

(58) Field of Classification Search ..... 345/88–90, 345/99–101, 212–214, 690; 348/609, 614, 348/622, 631

See application file for complete search history.

(56) References Cited

U.S. PATENT DOCUMENTS

| | | | | |
|---|---|---|---|---|
| 5,528,257 | A | 6/1996 | Okumura | |
| 7,106,286 | B2 * | 9/2006 | Baba et al. | 345/88 |
| 7,184,008 | B2 * | 2/2007 | Baba et al. | 345/88 |
| 7,427,976 | B2 * | 9/2008 | Sugino | 345/101 |
| 2004/0125064 | A1 | 7/2004 | Adachi et al. | |
| 2005/0162359 | A1 | 7/2005 | Sugino | |

FOREIGN PATENT DOCUMENTS

| | | | |
|---|---|---|---|
| EP | 1507252 | A1 | 2/2005 |
| JP | 64-10299 | A | 1/1989 |
| JP | 7-20828 | A | 1/1995 |
| JP | 2650479 | | 5/1997 |
| JP | 2708746 | | 10/1997 |
| JP | 2004-133159 | | 4/2004 |
| JP | 2004-133159 | A | 4/2004 |
| JP | 2004-246312 | A | 9/2004 |
| WO | WO 03/098588 | A1 | 11/2003 |
| WO | WO 2004/034135 | A1 | 4/2004 |

* cited by examiner

*Primary Examiner* — Kevin M Nguyen
(74) *Attorney, Agent, or Firm* — Harness, Dickey & Pierce, P.L.C.

(57) ABSTRACT

A modulation processing section compares video data of a current frame and a previous frame representative value supplied from a frame memory, corrects the video data so that a gradation transition from a gradation indicated by the previous frame representative value to a gradation indicated by the video data is emphasized, and outputs the corrected video data. A judgment section compares both of the data and judges, out of a value calculated from the previous frame representative value by a representative value generating section and the video data, which is to be stored in the frame memory till a next frame begins. This allows for realizing a liquid crystal display device capable of preventing with a relatively small-scale circuit (alternatively, a relatively small amount of calculation) a phenomenon such that: although a response speed of a pixel is improved, the emphasis modulation and a response delay of the pixel are combined so that image quality in displaying moving images deteriorates.

19 Claims, 20 Drawing Sheets

FIG. 4

| | | CURRENT VIDEO DATA | | | | | | | | |
|---|---|---|---|---|---|---|---|---|---|---|
| | | S0 | S32 | S64 | S96 | S128 | S160 | S192 | S224 | S255 |
| PREVIOUS VIDEO DATA (REPRESENTATIVE VALUE) | S0 | S0 | S49 | S115 | S144 | S161 | S188 | S209 | S240 | S255 |
| | S32 | S0 | S36 | S85 | S125 | S147 | S181 | S207 | S238 | S255 |
| | S64 | S0 | S21 | S64 | S106 | S138 | S175 | S204 | S236 | S255 |
| | S96 | S0 | S16 | S54 | S96 | S133 | S171 | S201 | S233 | S255 |
| | S128 | S0 | S11 | S46 | S89 | S128 | S167 | S198 | S231 | S255 |
| | S160 | S0 | S7 | S41 | S80 | S118 | S160 | S195 | S228 | S255 |
| | S192 | S0 | S4 | S36 | S73 | S110 | S155 | S192 | S226 | S255 |
| | S224 | S0 | S2 | S30 | S65 | S99 | S149 | S186 | S224 | S255 |
| | S255 | S0 | S1 | S27 | S58 | S91 | S143 | S181 | S222 | S255 |

FIG. 16 (a) PANEL TEMPERATURE 40°C
FIG. 16 (b) PANEL TEMPERATURE 15°C
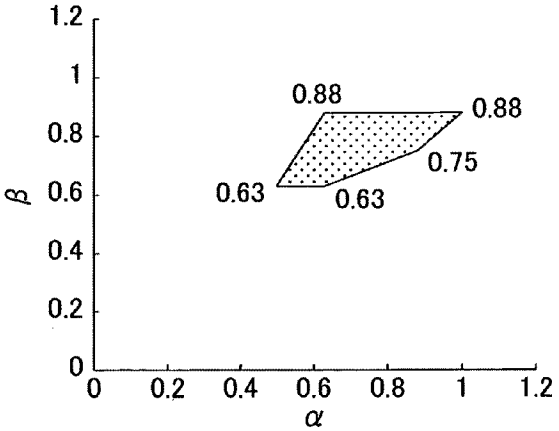
FIG. 16 (c) PANEL TEMPERATURE 5°C
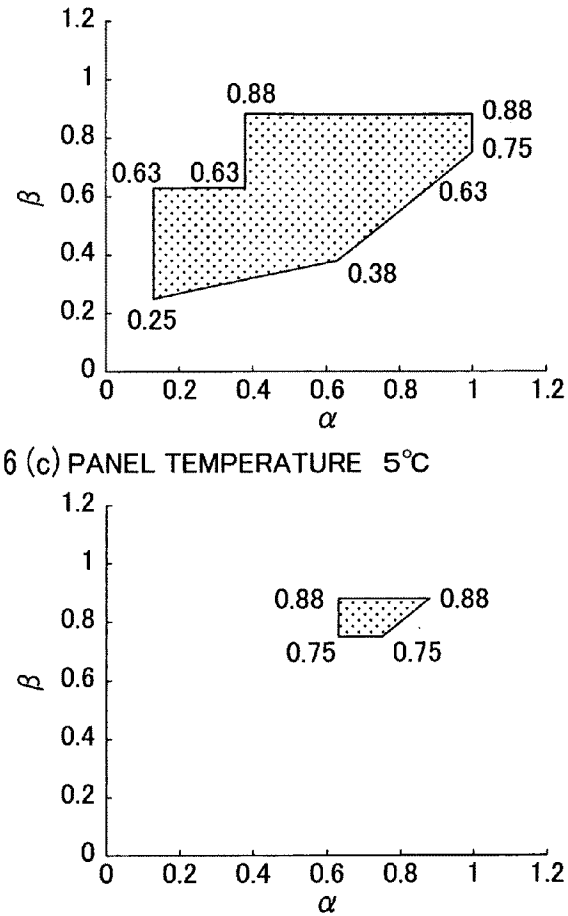

DISPLAY CONTROL METHOD, DRIVING DEVICE FOR DISPLAY DEVICE, DISPLAY DEVICE, PROGRAM, AND STORAGE MEDIUM

TECHNICAL FIELD

The present invention relates to (i) a display control method allowing for reducing with a relatively small-scale circuit (alternatively, a relatively small amount of calculation) a phenomenon such that: although a response speed of a pixel is improved, the emphasis modulation and a response delay of the pixel are combined so that current luminance of the pixel is greatly different from luminance of current video data, resulting in excess brightness or poor brightness which deteriorates image quality in displaying moving images, (ii) a driving device for driving a display device by using the method, (iii) a display device including the driving device, (vi) a program for the driving device, and (v) a storage medium.

BACKGROUND ART

Compared with CRT (Cathode-Ray Tube) displays which have been widely used, liquid crystal display devices are flatter, lighter, consumes smaller energy, and are capable of having high definition. Due to such characteristics, liquid crystal display devices are widely used not only for portable apparatuses but also for monitors of laptop computers and desktop computers. However, liquid crystal display devices are inferior to CRT displays in that the liquid crystal display devices have a slower response speed and lower quality of moving pictures. For that reason, various methods have been discussed so as to improve liquid crystal display devices in terms of liquid crystal materials, panel structures, driving methods, and the like.

Patent Citation 1 (Japanese Patent No. 2650479; published on Jul. 29, 1991) discloses a driving method as described below. In a case where a gradation transition is not completed within a rewrite time (16.7 μm) corresponding to a frame frequency (60 HZ), a liquid crystal display device using the driving method carries out a gradation transition from a previous gradation to a current gradation so that a current driving signal is modulated, thereby completing a response in one frame. The following explains the method with reference to FIGS. 20 and 21.

As an example, in a liquid crystal panel having a TN (Twisted Nematic) liquid crystal in a reflective mode and having a minimum voltage of 2.0V at which a liquid crystal does not transmit light and having a maximum voltage of 3.5V at which the liquid crystal transmits a maximum amount of light, it is assumed that when an applied voltage V1 of 2.0V is applied until a frame FR(2) ends and the applied voltage V1 is changed to V5(2.5V) in and after a next frame FR(3), a transmittance amount of a pixel in the liquid crystal panel changes as illustrated in FIG. 20.

In this case, a period from a time when the applied voltage changes to V5 to a time when a transmittance amount of the pixel reaches a predetermined value and luminance of the pixel reaches a desired value (luminance corresponding to V5) is approximately 70 to 100 msec. In this case, a response time for the pixel to have a desired transmittance amount (luminance) is two frames or more, so that image smearing occurs in an image displayed on the liquid crystal panel. Note that, "image smearing" in an image is a phenomenon in which transmittance of a liquid crystal does not change in line with a change in a voltage applied on a pixel and therefore a change in a display pixel causes an image of a previous field to be displayed shadowily at an outline of a current image. The phenomenon occurs when an image moves at a predetermined speed or more. The phenomenon greatly deteriorates image quality.

In general, a transmittance amount of a liquid crystal increases more rapidly as a larger voltage is applied. In a case where applying a voltage V5 in FR(3) would not allow luminance of a pixel to reach a desired value (luminance corresponding to V5) at a beginning of the next frame FR(4), voltage data is corrected so that a voltage higher than the voltage V5 is applied in the frame FR(3) where the voltage V5 is applied, thereby allowing for increasing a response speed of a liquid crystal. If the response speed of a liquid crystal display is more than a predetermined value, then it is possible to always complete a response of a liquid crystal within one frame.

To be more specific, a liquid crystal control circuit compares data of frame FR(2) and data of frame FR(3) so as to comprehend an amount of a voltage change in a pixel, and causes a data corrector (see FIG. 2 of Patent Citation 1) to correct the data of frame FR(3) from S5 to S7. Accordingly, a source driving IC (see FIG. 1 of Patent Citation 1) for driving a source signal line (data signal line) applies, on the source signal line, a voltage V7 corresponding to the corrected voltage data S7.

Therefore, rising characteristics of a liquid crystal are improved compared with a case where the voltage V5 corresponding to S5 which is not corrected is applied (a case of FIG. 20). Consequently, a desired transmittance amount T5 can be obtained in one frame which is FR(3). Note that, for convenience of explanation, in FIGS. 20 and 21, (i) a period during which data (e.g. S5) is supplied to a data corrector, (ii) a period during which the data corrector corrects the data and outputs generated data (e.g. S7), and (iii) a period during which a source driving IC applies a voltage (e.g. V7) corresponding to the corrected voltage data on a pixel are shown so that periods (i), (ii), and (iii) are disposed in a longitudinal direction, and the data or the voltage is referred to as data or a voltage of a frame (e.g. FR(3)). Further, a change in luminance of a pixel from a time when a voltage of one frame is applied to a time when a next voltage is applied is referred to as a change in luminance of the frame, and the change in luminance of the frame is shown so as to be disposed in a longitudinal direction under or above a period during which a voltage of the frame is applied.

As described above, a current driving signal is modulated by using a driving method disclosed in later-mentioned Citation 1, so that it is possible to always complete a response of a pixel in one frame if a response speed of a liquid crystal has a predetermined value or more.

However, in a case where a response of a liquid crystal is not completed in one frame although the above driving method is adopted, that is, in a case where a response of a liquid crystal is slow and a currently desired gradation is not realized even if a current driving signal is modulated so as to emphasis a gradation transition, a next driving signal is modulated and a next gradation transition is emphasized assuming that a current gradation transition has been completed in a transition from a current gradation to a next gradation. Consequently, next modulation may be performed incorrectly. Particularly in a change from decay to rise, a next gradation transition is emphasized too much, so that display quality may be greatly deteriorated. The following explains such a situation with reference to FIGS. 22 and 23.

FIG. 22 illustrates an example of changes in data, voltages, and a transmittance amount in a case where a gradation transition is emphasized. Here, a range of a driving voltage for a driving driver of a liquid crystal display element is limited. Furthermore, due to liquid crystal characteristics, a voltage whose r.m.s. value is 0V or less cannot be applied. For that reason, in a case of a low temperature at which response characteristics of a liquid crystal display element itself are lower than those at a normal temperature, or in a case where a response speed of a liquid crystal display element itself is slow, voltage application for emphasizing a gradation transition cannot be performed, so that a response of a liquid crystal may not be completed in one frame.

FIG. 22 illustrates a case where input data changes from S5 to S1 in a gradation transition from frame FR(2) to frame FR(3). In this example, a change in a transmittance amount lasts three frames, that is, a response time to reach a desired transmittance amount requires three frames.

Under the circumstance, assume that data S5 is supplied in FR(4). At that time, data changes from S1 to S5. Therefore, if a gradation transition is emphasized so that data changes from S1 to S7 and a driving voltage V7 corresponding to S7 is applied as with the case of FIG. 21 in which a pixel has already reached a transmittance amount corresponding to S1, then the gradation transition is emphasized too much.

To be specific, assume that, as illustrated in FIG. 23, a gradation transition is emphasized so that data changes from S1 to S7 as with the case of FIG. 21, although a response of a transmittance amount from S5 to S1 is not completed in one frame. At that time, at the end of frame FR(3), although transmittance amount T1 corresponding to data S1 is not yet realized, a voltage V7 is applied so that a transmittance amount changes from T1 to T5. Consequently, the gradation transition is emphasized too much. As a result, a transmittance amount of a pixel at the end of frame FR(4) exceeds a desired transmittance amount T5. At that time, a user recognizes excess brightness on a display device. This results in great deterioration in display quality.

On the other hand, Patent Citation 2 (Japanese Patent No. 2708746; published on Jan. 13, 1989) discloses an arrangement in which: instead of storing gradation data of a current frame in a frame memory till a next frame begins, data determined by estimating a state of a liquid crystal at the beginning of a next frame is stored in the frame memory.

To be specific, a correction circuit estimates that if a voltage corresponding to gradation data supplied in a current frame is applied on a liquid crystal, then what gradation corresponds to transmittance of the liquid crystal after one frame, and the correction circuit writes data indicative of the gradation in the frame memory and causes the frame memory to store the data till a next frame begins.

As a result, data read from the frame memory in each frame is data indicating that if a voltage corresponding to gradation data supplied in a previous frame is applied on a liquid crystal, then what gradation corresponds to transmittance of the liquid crystal in a current frame which is one frame after the previous frame. Therefore, unlike an arrangement in which gradation data of a previous frame is stored till a next frame and the gradation data of the previous frame is compared with gradation data of a current frame so as to correct the gradation data of the current frame, if estimation is correct, too much correction can be prevented, so that excess brightness can be prevented.

In the arrangement, if estimation is correct, then it is possible to prevent deterioration in image quality due to too much correction. However, if estimation has errors, then the errors are accumulated and it may be difficult to perform suitable correction.

Consequently, accuracy in the estimation must be maintained so that accumulation of errors does not result in great deterioration in image quality. This increases an amount of calculation for estimation and a size of a circuit necessary for the estimation.

DISCLOSURE OF INVENTION

An object of the present invention is to realize a liquid crystal display device capable of preventing with a relatively small-scale circuit (alternatively, a relatively small amount of calculation) a phenomenon such that: although a response speed of a pixel is improved, the emphasis modulation and a response delay of the pixel are combined so that current luminance of the pixel is greatly different from luminance of current video data, resulting in excess brightness or poor brightness which deteriorates image quality in displaying moving images.

A display control method of the present invention includes the steps of: (I) determining a representative value for correcting sets of video data serially supplied to a pixel of a display device, the determining being performed with respect to each of the sets of video data; (II) storing the representative value till a next determining is performed; and (III) modulating current video data by referring to a previous representative value stored in the step (II), the modulating being performed so that a change from the previous representative value to the current video data is emphasized, the step (I) including the sub-steps of: (i) judging whether the current video data is to be regarded as a representative value or not, by comparing the previous representative value stored in the step (II) and the current video data, and (ii) when it is judged that the current video data is not to be regarded as a representative value in the sub-step (i), calculating a representative value, through a predetermined procedure, based on at least the previous representative value out of the current video data and the previous representative value.

If a representative value used in modulating video data allows for estimating with enough accuracy luminance of a pixel at a time when a signal corresponding to corrected video data is applied on the pixel (luminance at a time of signal application), then it is possible to modulate the video data to an appropriate extent in the step (III). Therefore, in this case, it is possible to prevent excessive emphasis or shortage of emphasis in modulation, so that it is possible to prevent deterioration in image quality in displaying moving images, the deterioration being caused because modulation is set to an inappropriate extent. However, if the estimation includes errors, then it is impossible to perform modulation to an appropriate extent, although an estimation value is referred. This results in deterioration in image quality in displaying moving images.

In a case where, instead of video data of a current frame, a value calculated through the above procedure (calculation value) is stored as a representative value till a next frame and a next representative value is calculated by referring to the representative value, estimation including errors is accumulated. For that reason, in the arrangement in which a calculation value (estimation value) is always regarded as a representative value, calculation for estimation in the sub-step (ii) needs accuracy which allows for preventing the deterioration in image quality even if estimation errors are accumulated. Consequently, an amount of necessary calculation and a size of a circuit necessary for the calculation are relatively large.

On the other hand, with the method of the present invention, in a case where it is judged that current video data is to be regarded as a representative value, the video data is stored as a representative value till a next frame and is used to correct video data to be supplied to a pixel. Consequently, even if an error occurs while the calculation value is regarded as a representative value, the error is not accumulated. As a result, it is possible to allow accuracy in the calculation for estimation to be lower than the accuracy which allows for preventing the deterioration in image quality. Consequently, it is possible to downsize the amount of necessary calculation and the size necessary for the calculation, compared with the arrangement in which the estimation is always performed.

Consequently, it is possible to reduce with a relatively small-scale circuit (alternatively, with a relatively small amount of calculation) a phenomenon such that: although a response speed of a pixel is improved by modulating current video data so that a change from a previous representative value to the current video data is emphasized, the emphasis modulation and a response delay of the pixel are combined so that current luminance of the pixel is greatly different from luminance of the current video data, resulting in excess brightness or poor brightness which deteriorates image quality in displaying moving images.

Note that, if a representative value is obtained from a previous representative value in the sub-step (ii) and if judgment is performed in the sub-step (i) based on whether the calculation estimation is necessary or not, then it is possible to effectively prevent the phenomenon while further downsizing an amount of necessary calculation and a size of a circuit necessary for the calculation.

In addition to the arrangement, the display control method may be arranged so that: D1 is calculated in the sub-step (ii) based on an equation $D1=D0(n-1)\times\beta$, where $D0(n-1)$ indicates the previous representative value, D(n) indicates the current video data, D1 indicates a representative value calculated when the judgment means compares D(n) with $D0(n-1)$ and judges that D(n) is not to be regarded as a representative value, and $\beta$ indicates a predetermined constant of more than 0 and less than 1, and it is judged in the sub-step (i) whether the current video data is to be regarded as a representative value or not based on whether an inequality $D(n)>\alpha\times D0(n-1)$ is satisfied or not, where $D0(n-1)$ indicates the previous representative value, D(n) indicates the current video data, and $\alpha$ indicates a predetermined constant of more than 0 and less than 1.

With the arrangement, the judgment and the calculation of a representative value are performed as described above. Therefore, it is possible to effectively prevent the phenomenon while downsizing an amount of calculation necessary for the calculation and the judgment and downsizing a size of a circuit necessary for the calculation.

To be more specific, in a case where a response delay of a pixel which is caused due to driving of a pixel in response to corrected video data is relatively small, luminance of the pixel at a time when a signal corresponding to next corrected video data is applied on the pixel (luminance at a time when a gradation transition ends) changes due to an influence not only from luminance of the pixel at a time when a signal corresponding to current corrected video data is applied on a pixel (luminance at a time when a gradation transition begins) but also from the current corrected video data.

However, as the response delay gets greater, luminance at a time when the gradation transition begins influences more greatly on luminance at a time when the gradation transition ends. Assume a situation in which: response delay of the pixel driven in response to corrected video data is too large (response of the pixel reaches the limit) and if modulation is performed in a next frame to the same extent as a case where response does not delay, then image quality in displaying moving images deteriorates greatly. In the situation, luminance at a time when the gradation transition ends is not influenced by current corrected video data but influenced by luminance at a time when the gradation transition begins. In this case, by calculating the representative value D1 based on $D1=D0(n-1)\times\beta$, it is possible to estimate luminance at a time when the gradation transition ends, with relatively high accuracy and with a relatively small amount of calculation (alternatively, a relatively small-scale circuit).

Further, deterioration in image quality due to the limit of a response occurs both in a case where a gradation transition for greatly decreasing luminance is performed and then luminance is increased and in a case where a gradation transition for greatly increasing luminance is performed and then luminance is decreased. However, when a next gradation transition is emphasized to the same extent as a case where a response delay does not occur in a first gradation transition, luminance deteriorates undesirably and poor brightness occurs in the latter case, while luminance increases undesirably and excess brightness occurs in the former case. Excess brightness is more likely to be recognized by a user and therefore image quality deteriorates more greatly in a case where a response delay in a gradation transition for greatly decreasing luminance is not corrected. For that reason, comparison between the former case and the latter case shows that preventing deterioration in image quality at a time when luminance decreases would more effectively allow for preventing deterioration in image quality with a smaller amount of calculation or a smaller size of a circuit, resulting in particularly greater improvement in display quality. A response speed of a pixel at a time when luminance decreases is more likely to be limited as a ratio of a current representative value to previous video data is smaller. If the ratio is a predetermined value or more, then the response speed is not limited.

Therefore, by judging whether current video data is to be regarded as a representative value or not based on whether the inequality $D(n)>\alpha\times D0(n-1)$ is satisfied or not, it is possible to judge, with a relatively simple calculation and relatively high accuracy, which case is more likely to cause deterioration in image quality out of a case where the representative value D1 is calculated based on $D1=D0(n-1)\times\beta$ and a case where D1=D(n). Consequently, it is possible to effectively prevent the phenomenon while downsizing an amount of calculation necessary for the judgment and a size of a circuit necessary for the judgment.

Further, in order to achieve the foregoing object, a display control method of the present invention includes the step of: when sets of video data serially supplied to a pixel of a display device indicate that luminance of the pixel rises and decays repeatedly and gradations indicated by serially supplied video data out of the sets of video data are indicated by C, B, and A in an order of supply where C>B, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

Further, in order to achieve the foregoing object, a display control method of the present invention includes the step of: when gradations indicated by sets of video data serially supplied to a pixel of a display device are indicated by C, B, and A in an order of supply, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

As described above, as the response delay gets greater, luminance at a time when the gradation transition begins influences more greatly on luminance at a time when the gradation transition ends. Assume a situation in which: response delay of the pixel driven in response to corrected video data is too large (response of the pixel reaches the limit) and if modulation is performed in a next frame to the same extent as a case where response does not delay, then image quality in displaying moving images deteriorates greatly. Particularly in the situation, luminance at a time when the gradation transition ends is not influenced by current corrected video data but influenced by luminance at a time when the gradation transition begins.

Further, as described above, image quality is greatly deteriorated in a case where a gradation transition for greatly decreasing luminance is performed and then luminance is increased and, in addition, a response speed of a pixel is limited in the gradation transition for greatly decreasing luminance. Further, a response speed of a pixel is more likely to be limited as a ratio of current video data to previous video data is smaller. If the ratio is a predetermined value or more, then the response speed is not limited.

Therefore, by correcting A as described above, the phenomenon can be effectively prevented as with the above arrangement. Further, gradation C indicated by only two-frame-previous video data is referred to in generating the corrected A in the above. Consequently, even if the estimation errors are accumulated, it is possible to prevent the size of a circuit from being increased, compared with the arrangement in which estimation calculation is performed, that is, the arrangement in which luminance at a time of voltage application is estimated and calculated with such accuracy as to prevent the deterioration in image quality. As a result, it is possible to effectively prevent the phenomenon while downsizing an amount of calculation necessary for calculation and judgment and the size of a circuit necessary for the calculation.

Note that, with the arrangement in which whether current video data is to be regarded as a representative value or not is judged based on whether the inequality $D(n)>\alpha\times D\mathbf{0}(n-1)$ is satisfied or not, merely storing one-previous video data or a one-previous representative value allows for an arrangement in which the correcting step is performed when it is indicated that luminance of the pixel rises and decays repeatedly. Therefore, it is possible to prevent an increase in a size of a circuit.

Further, in order to achieve the foregoing object, a driving device of the present invention for a display device includes: representative value generating means for determining a representative value for correcting sets of video data serially supplied to a pixel of the display device, the determining being performed with respect to each of the sets of video data; representative value storage means in which the representative value is stored till a next determining is performed; and modulation means for modulating current video data by referring to a previous representative value stored in the representative value storage means, the modulating being performed so that a change from the previous representative value to the current video data is emphasized, the representative value generating means including: judgment means for judging whether the current video data is to be regarded as a representative value or not, by comparing the previous representative value stored in the representative value storage means and the current video data; and calculation means for, when the judgment means judges that the current video data is not to be regarded as a representative value, calculating the representative value, through a predetermined procedure, based on at least the previous representative value out of the current video data and the previous representative value.

The driving device includes the means, so that the driving device can drive a display device through the display control method. Therefore, as with the display control method, it is possible to increase a response speed of a pixel and to prevent the phenomenon with a relatively small-scale circuit (alternatively, a relatively small amount of calculation).

Further, in addition to the arrangement, the driving device may be arranged so that the calculation means calculates the representative value based on the previous representative value. Further, in addition to the arrangement, the driving device may be arranged so that: the calculation means calculates $D\mathbf{1}$ based on an equation $D\mathbf{1}=D\mathbf{0}(n-1)\times\beta$, where $D\mathbf{0}(n-1)$ indicates the previous representative value, D(n) indicates the current video data, $D\mathbf{1}$ indicates a representative value calculated when the judgment means compares D(n) and $D\mathbf{0}(n-1)$ and judges that D(n) is not to be regarded as a representative value, and $\beta$ indicates a predetermined constant of more than 0 and less than 1.

With the arrangements, the representative value is calculated based on a previous representative value, so that it is possible to effectively prevent the phenomenon while downsizing an amount of necessary calculation and a size of a circuit necessary for the calculation. In particular, in a case where the representative value $D\mathbf{1}$ is calculated based on the equation $D\mathbf{1}=D\mathbf{0}(n-1)\times\beta$, the representative value $D\mathbf{1}$ is obtained by a simple multiplication. Consequently, it is possible to further downsize an amount of calculation necessary for obtaining the representative value $D\mathbf{1}$ or a size of a circuit necessary for the calculation, compared with a case where the representative value $D\mathbf{1}$ is obtained by referring to a look-up table for example.

To be more specific, in a case where a response delay of a pixel which is caused due to driving of a pixel in response to corrected video data is relatively small, luminance of the pixel at a time when a signal corresponding to next corrected video data is applied on the pixel (luminance at a time when a gradation transition ends) changes due to an influence not only from luminance of the pixel at a time when a signal corresponding to current corrected video data is applied on a pixel (luminance at a time when a gradation transition begins) but also from the current corrected video data.

However, as the response delay gets greater, luminance at a time when the gradation transition begins influences more greatly on luminance at a time when the gradation transition ends. Assume a situation in which: response delay of the pixel driven in response to corrected video data is too large (response of the pixel reaches the limit) and if modulation is performed in a next frame to the same extent as a case where response does not delay, then image quality in displaying moving images deteriorates greatly. In the situation, luminance at a time when the gradation transition ends is not influenced by current corrected video data but influenced by luminance at a time when the gradation transition begins. Therefore, in this case, by calculating the representative value based on a previous representative value, it is possible to estimate luminance at a time when the gradation transition ends, with relatively high accuracy and with a relatively small amount of calculation (alternatively, a relatively small-scale circuit).

Therefore, it is judged whether the situation occurs or not by comparing a previous representative value and current video data and the calculation means calculates a representative value based on the previous representative value, so that it is possible to effectively prevent the phenomenon while downsizing an amount of necessary calculation and a size of a circuit necessary for the calculation.

Further, in addition to the arrangement, the driving device may be arranged so that: the judgment means judges whether the current video data is to be regarded as a representative value or not based on whether an inequality $D(n)>\alpha\times D0(n-1)$ is satisfied or not, where $D0(n-1)$ indicates the previous representative value, D(n) indicates the current video data, and a indicates a predetermined constant of more than 0 and less than 1.

Here, as described above, deterioration in image quality due to the limit of a response occurs both in a case where a gradation transition for greatly decreasing luminance is performed and then luminance is increased and in a case where a gradation transition for greatly increasing luminance is performed and then luminance is decreased. However, when a next gradation transition is emphasized to the same extent as a case where a response delay does not occur in a first gradation transition, luminance deteriorates undesirably and poor brightness occurs in the latter case, while luminance increases undesirably and excess brightness occurs in the former case. Excess brightness is more likely to be recognized by a user and therefore image quality deteriorates more greatly in a case where a response delay in a gradation transition for greatly decreasing luminance is not corrected. For that reason, comparison between the former case and the latter case shows that preventing deterioration in image quality at a time when luminance decreases would more effectively allow for preventing deterioration in image quality with a smaller amount of calculation or a smaller size of a circuit, resulting in particularly greater improvement in display quality. A response speed of a pixel at a time when luminance decreases is more likely to be limited as a ratio of a current representative value to previous video data is smaller. If the ratio is a predetermined value or more, then the response speed is not limited.

Therefore, by judging whether current video data is to be regarded as a representative value or not based on whether the inequality $D(n)>\alpha\times D0(n-1)$ is satisfied or not, it is possible to judge, with a relatively simple calculation and relatively high accuracy, which case is more likely to cause deterioration in image quality out of a case where the representative value D1 is calculated based on $D1=D0(n-1)\times\beta$ and a case where D1=D(n). Consequently, it is possible to effectively prevent the phenomenon while downsizing an amount of calculation necessary for the judgment and a size of a circuit necessary for the judgment.

On the other hand, in order to achieve the foregoing object, a driving device of the present invention for a display device includes correcting means for: when sets of video data serially supplied to a pixel of the display device indicate that luminance of the pixel rises and decays repeatedly and gradations indicated by serially supplied video data out of the sets of video data are indicated by C, B, and A in an order of supply where C>B, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

Further, in order to achieve the foregoing object, a driving device of the present invention for a display device includes correcting means for: when gradations indicated by sets of video data serially supplied to a pixel of the display device are indicated by C, B, and A in an order of supply, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

With the arrangements, each of the correcting means can perform the correction process. Therefore, as with the display control method, the arrangements allow for effectively preventing the phenomenon while downsizing an amount of calculation necessary for the calculation and the judgment and a size of a circuit necessary for the calculation.

The constants α, β and k may be invariable regardless of a temperature. Some display elements have response characteristics which change in line with a temperature, particularly in a case of liquid crystal display elements. In the case of such display elements, optimal α, β and k and their numerical ranges vary in accordance with a temperature. At a certain temperature, α, β and k may be optimal, but at other temperature (such as a lower temperature), the α, β and k are not optimal. In a case where the α, β and k are not optimal, if deterioration in image quality is within a range allowed by a user, then it is possible to display moving images with enough high quality. However, in a case where a panel temperature drops greatly and response speed of the pixel drops greatly, if constants α, β and k are fixed, then there is a possibility that image quality deteriorates out of the range allowed by the user.

On the other hand, in addition to the arrangement, if the driving device includes temperature correcting means for adjusting the constant (at least one of α, β and k) in accordance with a temperature, then it is possible to change at least one of α, β and k in accordance with a temperature. Therefore, even when there is provided a display element whose response characteristics change in accordance with a temperature, it is possible to prevent the above phenomenon in which image quality is deteriorated because modulation is performed to the same extent as a case where the response delay does not occur, the above phenomenon being prevented in a wider range of a temperature and with higher accuracy than the arrangement in which the constants α, β or k are fixed.

Further, in addition to the arrangement, the driving device may be arranged so as to include adjustment means for adjusting the constant (at least one of α, β and k) in response to an adjustment instruction which is externally given. With the arrangement, at least one of the constants α, β and k is adjusted in response to the adjustment instruction which is externally given. Therefore, even if a driving device for a display device is fabricated so as to be commonly used among display devices having different characteristics due to fabrication unevenness or due to structural differences, it is possible to adjust at least one of α, β and k of the driving device for each display device so that said at least one of α, β and k is suitable for characteristics of the display device. Consequently, it is possible to save time and troubles in fabrication and to design more freely.

Further, the driving device may be arranged so that: the modulation means includes at least one look-up table in which a parameter corresponding to a combination of a value supplied as the previous representative value and a value supplied as the current video data is stored in advance, and the modulation means generates modulated current video data by referring to said at least one look-up table.

With the arrangement, the modulation means refers to the look-up table so as to generate modulated current video data. Assume that a display device has response characteristics such that: if modulated current video data is to be generated based on a value supplied as the previous representative value and a value supplied as current video data, a relatively complicated calculation is necessary, which increases an amount of calculation or a size of a circuit. Even when a display device has such response characteristics, the arrangement allows for preventing an increase in a size of a circuit or an amount of calculation, compared with an arrangement in which modulated current video data is generated based only on calculation.

Further, in addition to the arrangement, the driving device may be arranged so that said at least one look-up table includes a plurality of look-up tables, and the modulation means switches, in accordance with a temperature, the look-up tables to be referred to in generating the modulated current video data.

With the arrangement, the look-up tables to be referred to in generating the modulated current video data are switched in accordance with a temperature, so that modulated current video data is generated. Assume a case where there is used a display device whose response characteristics are such that if a look-up table suitable for other temperature is to be generated based on a look-up table suitable for a certain temperature and the temperature, then a relatively complicated calculation is required and a calculation amount or a circuit size increases, for example, a case where there is used a display device whose response characteristics change greatly in accordance with a change in a temperature. Even in the case, the arrangement allows for preventing an increase in a circuit size or a calculation amount, compared with an arrangement in which modulated current video data is generated based only on calculation.

In order to achieve the foregoing object, a display device of the present invention includes the driving device having any one of the above arrangements. Therefore, as with the driving device, the display device allows for, with a relatively small-scale circuit (alternatively, a relatively small amount of calculation), an increase in a response speed of a pixel and prevention of the phenomenon.

Further, in addition to the arrangement, the display device may be arranged so as to include, as a display element, a liquid crystal display element in vertical alignment mode and in normally black mode.

In a case where a pixel is a liquid crystal display element in normally black mode and vertical alignment mode, a response speed of the pixel is slower in a gradation transition for decreasing luminance (a gradation transition for decay) than in a gradation transition for increasing luminance (a gradation transition for rise). Consequently, even though modulation is performed as described above, excess brightness or poor brightness due to modulation to the same extent as a case where a response delay does not occur is generated, which is likely to be recognized by a user.

In contrast, the arrangement allows for preventing excess brightness or poor brightness. Therefore, although a pixel is a liquid crystal display element in normally black mode and vertical alignment mode, it is possible to realize a liquid crystal display device capable of preventing the deterioration in image quality in displaying moving images.

Further, in addition to the arrangement, the display device may be a TV receiver which uses a liquid crystal display element as a display element, or may be a liquid crystal monitor. As described above, the display device including the driving device allows for, with a relatively small-scale circuit (alternatively, with a relatively small amount of calculation), an increase in a response speed of a pixel and prevention of the phenomenon. Therefore, the display device is preferably applicable to a TV receiver or a liquid crystal monitor.

The driving device may be realized by a computer or may be realized by causing a computer to execute a program. To be specific, a program of the present invention is a program for causing a computer to function as each means of the driving device. A storage medium of the present invention is a storage medium in which the program is stored.

If the program is executed by a computer, then the computer functions as the driving device. As with the driving device, this allows for, with a relatively small-scale circuit (alternatively, with a relatively small amount of calculation), an increase in a response speed of a pixel and prevention of the phenomenon.

As described above, with the present invention, it is judged whether current video data is to be regarded as a representative value or not, by comparing a previous representative value which is stored and the current video data, and when it is judged that the current video data is not to be regarded as the representative value, the representative value is calculated, through a predetermined procedure, based on at least the previous representative value out of the current video data and the previous representative value. Therefore, even if an error occurs while the calculation value is regarded as a representative value, the error is not accumulated. Consequently, accuracy in the estimation calculation can be lower. This allows for, with a relatively small-scale circuit (alternatively, with a relatively small amount of calculation), an increase in a response speed of a pixel and prevention of deterioration in image quality due to modulation performed to the same extent as a case where the response speed does not occur. Therefore, the present invention is preferably applicable to various display devices such as TV receivers and liquid crystal monitors or to driving of the various display devices.

BRIEF DESCRIPTION OF DRAWINGS

FIG. 4 is a table showing an example of contents of a look-up table provided in the modulation driving processing section.

FIGS. 16(*a*) to (*c*) are graphs showing desirable ranges of constants α and β at respective temperatures, the constants α and β being used for judgment and calculation of a representative value in the image display device. FIG. 16(*a*) shows the range at 40° C. FIG. 16(*b*) shows the range at 15° C. FIG. 16(*c*) shows the range at 5° C.

BEST MODE FOR CARRYING OUT THE INVENTION

Embodiment 1

The following explains an embodiment of the present invention with reference to FIGS. 1 to 17. An image display device 1 of the present embodiment is an image display device capable of preventing with relatively small-scale circuit a phenomenon that: although a gradation transition is emphasized from a one-previous frame to a current frame so as to increase a response speed of a pixel, the gradation transition emphasis and a response delay of a pixel in a gradation transition from a two-previous frame to the one-previous frame are combined, resulting in a great difference between a current gradation of the pixel and a gradation indicated by current video data, causing excess brightness or poor brightness.

Figure 2:
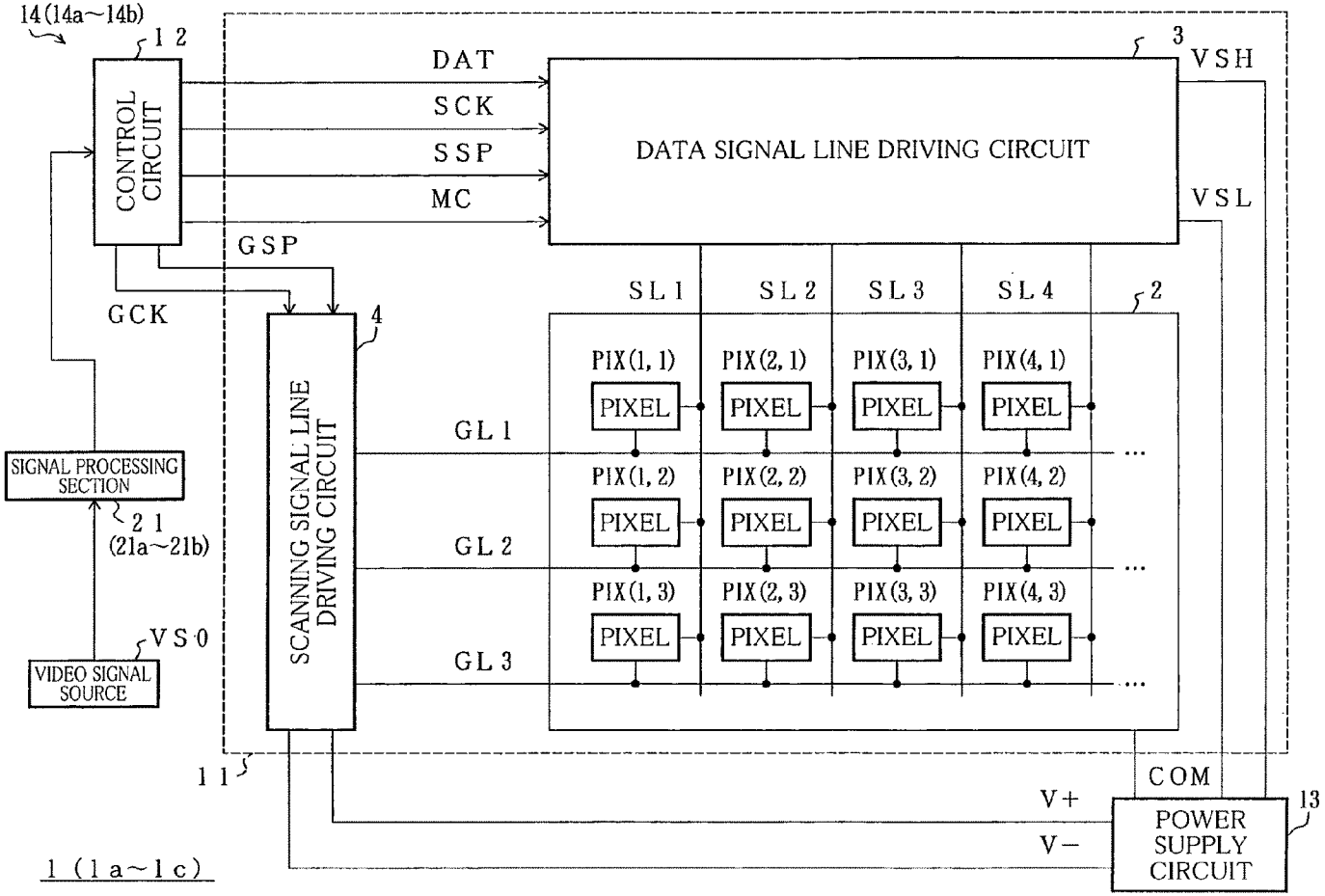
FIG. 2 is a block diagram illustrating a main structure of the image display device.

As illustrated in FIG. 2, a panel 11 of the image display device 1 includes: a pixel array 2 including pixels PIX(1,1) to PIX(n,m) provided in a matrix manner; a data signal line driving circuit 3 for driving data signal lines SL1 to SLn in the pixel array 2; and a scanning signal line driving circuit 4 for driving scanning signal lines GL1 to GLm in the pixel array 2. Further, the image display device 1 includes: a control circuit 12 for supplying a control signal to the data signal line driving circuit 3 and the scanning signal line driving circuit 4; and a modulation driving processing section (correcting means) 21 for modulating a video signal to be supplied to the control circuit 12 so that the gradation transition is emphasized based on a supplied video signal. These circuits operate using a power supplied from a power supply circuit 13.

Before explaining a detailed structure of the modulation driving processing section 21 serving as a driving device for a display device, the following explains a schematic structure and an operation of a whole of the image display device (display device) 1. For convenience of explanation, members of the image display device 1 are referred to with position-indicating numerals or alphabets attached thereto only when it is necessary to indicate positions, and the members are referred to without the numerals or the alphabets when it is unnecessary to indicate positions or when the members are referred to generically.

The pixel array 2 includes: a plurality of (n in this case) data signal lines SL1 to SLn; and a plurality of (m in this case) scanning signal lines GL1 to GLm which cross the data signal lines SL1 to SLn. Assuming that any integer from 1 to n and any integer from 1 to m are regarded as j, a pixel PIX (i,j) is provided with respect to each cross point of the data signal line SLi and the scanning signal line GLj. In the present embodiment, each pixel (i,j) is provided in an area surrounded by adjacent two data signal lines SL(i−1) and SLi and by adjacent two scanning signal lines GL(j−1) and GLj.

Figure 3:
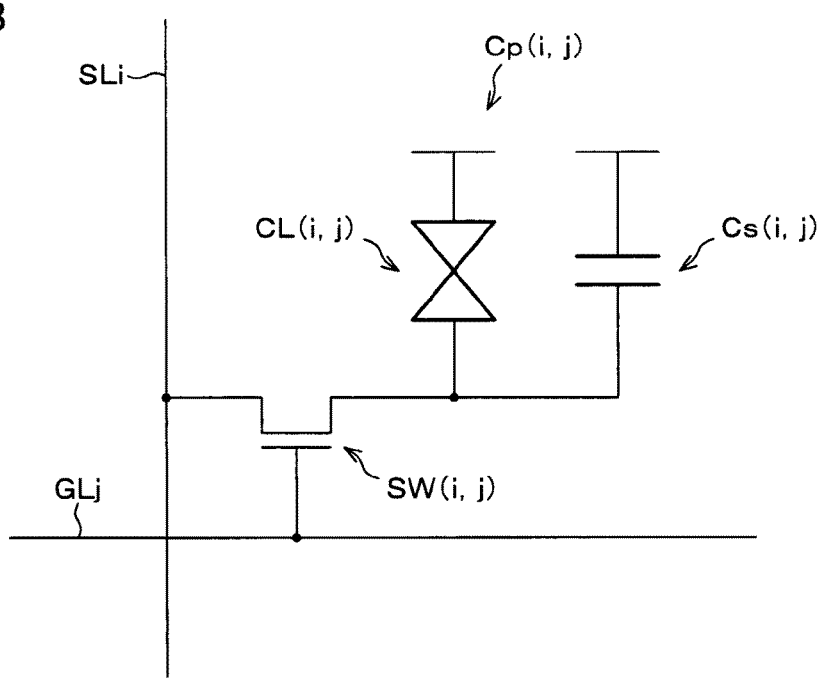
FIG. 3 is a circuit diagram illustrating an example of a structure of a pixel provided in the image display device.

The following exemplifies a case where the image display device 1 is a liquid crystal display device. As illustrated in FIG. 3 for example, the pixel PIX (i,j) includes: a field effect transistor SW (i,j) serving as a switching element, whose gate and drain are connected with the scanning signal line GLj and the data signal line SLi, respectively; and a pixel capacitor Cp (i,j) whose one electrode is connected with a source of the field effect transistor SW (i,j). Further, the other electrode of the pixel capacitor Cp (i,j) is connected with a common electrode line which is common among all pixel PIXs. The pixel capacitor Cp (i,j) includes a liquid crystal capacitor CL (i,j) and a subsidiary capacitor Cs (i,j) which is added if necessary.

In the pixel PIX (i,j), if the scanning signal line GLj is selected, then the field effect transistor SW(i,j) is conducted and a voltage applied on the data signal line SLi is applied on the pixel capacitor Cp(i,j). On the other hand, while the scanning signal line GLj stops to be selected and the field effect transistor SW(i,j) is not conducted, the pixel capacitor Cp(i,j) maintains a voltage at a time when the field effect transistor SW(i,j) gets non-conducted. Transmittance or reflectance of a liquid crystal changes in accordance with a voltage applied on the liquid crystal capacitor CL(i,j). Therefore, if the scanning signal line GLj is selected and a voltage corresponding to video data D to be supplied to the pixel PIX(i,j) is applied on the data signal line SLi, then it is possible to change a display of the pixel PIX(i,j) in accordance with the video data D.

The image display device 1 of the present embodiment uses, as a liquid crystal cell for the pixel array 2, a liquid crystal cell in vertical alignment mode, that is, a liquid crystal cell in which liquid crystal molecules are aligned substantially perpendicular to a substrate at a time when no voltage is applied and the liquid crystal molecules get inclined from a state of perpendicular alignment as a voltage is applied on the liquid crystal capacitor CL(i,j) of the pixel PIX (i,x). The liquid crystal cell is used in normally black mode (mode in which black display is maintained while no voltage is applied).

With the arrangement, the scanning signal line driving circuit 4 illustrated in FIG. 2 outputs, to scanning signal lines GL1 to GLm, a signal indicative of a select period. An example of the signal is a voltage signal. Further, the scanning signal line driving circuit 4 switches the scanning signal line GLj which outputs a signal indicative of the select period, in accordance with a timing signal supplied from the control circuit 12. Examples of the timing signal include a clock signal GCK and a start pulse signal GSP. Consequently, the scamming signal lines GL1 to GLm are serially selected at a predetermined timing.

Further, the data signal line driving circuit 3 extracts, as video signals DAT, video data D supplied by time division to the pixels PIX, the extraction being performed by sampling the video data D at predetermined timings. Moreover, the data signal line driving circuit 3 outputs, through the data signal lines SL1 through SLn, output signals corresponding to respective video data D to the pixels PIX(1,j) through (n,j) corresponding to the scanning signal line GLj selected by the scanning signal line driving circuit 4.

Note that, the data signal line driving circuit 3 determines timings of the sampling and output timings of the output signals in accordance with timing signals supplied from the control circuit 12, such as a clock signal SCK and a start pulse signal SSP.

While the scanning signal line GLj corresponding to the pixels PIX(1,j) through PIX(n,j) is selected, the pixels PIX(1, j) through PIX(n,j) adjust their luminance and transmittance to be provided during their light emissions so as to determine their brightness, in accordance with output signals supplied to the data signal lines SL1 through SLn corresponding to the PIX(1,j) through PIX(n,j).

Here, the scanning signal line driving circuit 4 sequentially selects the scanning signal lines GL1 through GLm. It is therefore possible to adjust brightness of all of the pixels PIX(1,1) through PIX(n,m) in the pixel array 2 to brightness (gradation) indicated by their corresponding video data, and it is also possible to update an image to be displayed on the pixel array 2.

The video data D may be a gradation level itself if a gradation level of a pixel PIX(i,j) can be specified, or may be a parameter with which a gradation level is calculated. The following explains a case where video data is a gradation level itself of a pixel PIX(i,j).

Further, in the image display device 1, a video signal DAT supplied from a video signal source VS0 to the modulation driving processing section 21 may be transmitted in a frame unit (whole screen unit) or may be transmitted so that one frame is divided into a plurality of fields and the video signal DAT is transmitted in a field unit. The following explains a case where the video signal DAT is transmitted in the field unit.

In the present embodiment, the video signal DAT supplied from the video signal source VS0 to the modulation driving processing section 21 is transmitted so that one frame is divided into a plurality of fields (e.g. two fields) and the video signal DAT is transmitted in a field unit.

To be more specific, when the video signal source VS0 transmits the video signal DAT to the modulation driving processing section 21 of the image display device 1 via a video signal line VL, the video signal source VS0 transmit sets of video data for fields by time division in such a manner so as to transmit whole video data for a certain field and then transmit video data for the subsequent field.

Further, the field includes a plurality of horizontal lines. Through the video signal line VL, sets of video data for horizontal lines are transmitted by time division in such a manner that all sets of video data for a certain horizontal line are transmitted and then sets of video data for the subsequent horizontal line are transmitted.

In the present embodiment, one frame includes two fields. Video data of an even-numbered horizontal line among horizontal lines making up one frame is transmitted for an even-numbered field. Video data of an odd-numbered horizontal line is transmitted for an odd-numbered field. Moreover, the video signal source S0 drives the video signal line VL by time division in transmitting video data of one horizontal line. Thus, sets of video data can be transmitted sequentially in a predetermined order.

Figure 1:
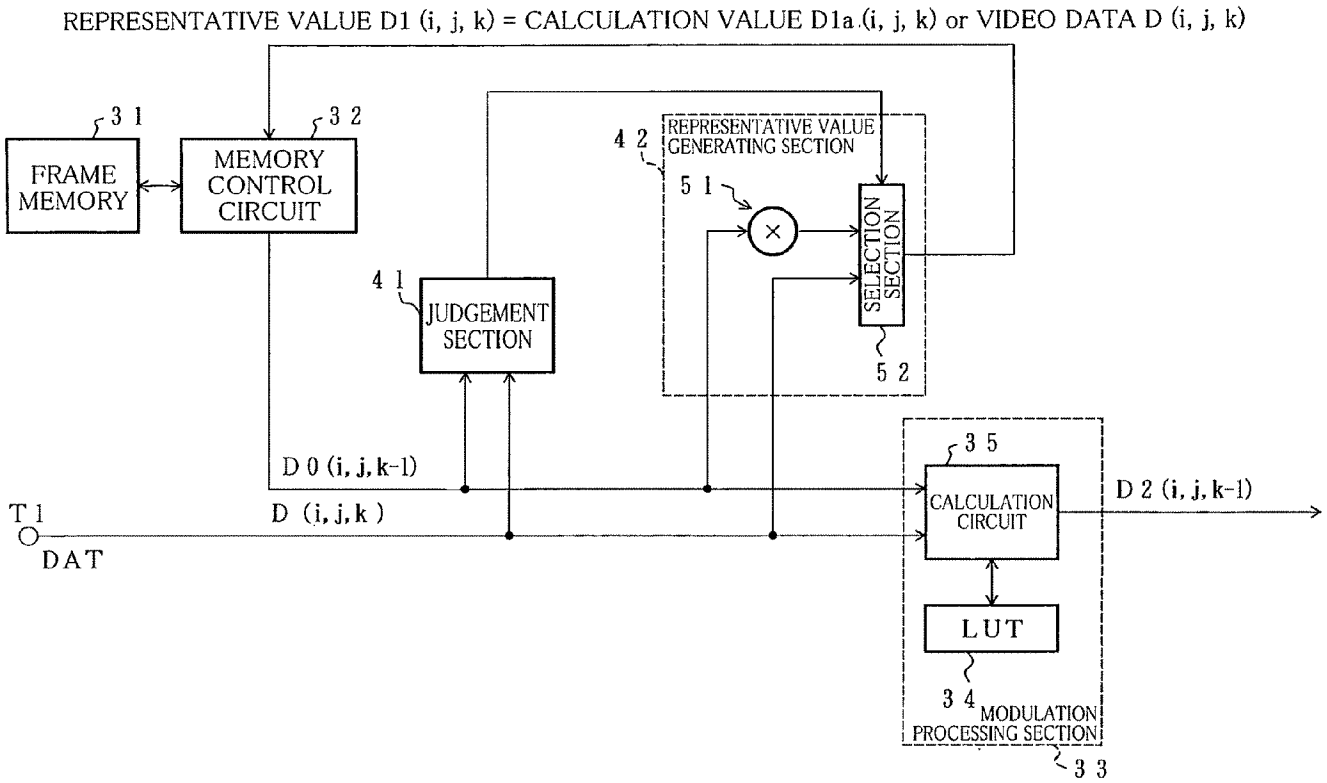
FIG. 1 is a block diagram of an embodiment of the present invention, illustrating a main structure of a modulation driving processing section of an image display device.

As illustrated in FIG. 1, the modulation driving processing section 21 includes: a frame memory (representative value storage means) 31 for storing video data of one frame till a next frame; a memory control circuit 32 for basically writing in the frame memory 31 video data D(i,j,k) of a current frame FR(k) supplied to an input terminal T1 and reading video data D0(i,j,k−1) of a previous frame FR(k−1) from the frame memory 31 and outputting the video data D0(i,j,k−1); and a modulation processing section (modulation means) 33 for correcting video data D(i,j,k) of the current frame FR(k) so as to emphasize a gradation transition from the previous frame FR(k−1) to the current frame FR(k) of a pixel PIX(i,j) and for outputting, as a correction video signal DAT2, video data D2(i,j,k) obtained from the correction.

To be more specific, with respect to a combination of a possible value (gradation) of a previous frame representative value D0(i,j,k−1) and a possible value (gradation) of video data D(i,j,k) of a current frame FR(k), the modulation processing section 33 of the present embodiment includes an LUT (Look-Up Table) 34 in which corrected video data D2(i, j,k) to be supplied when the combination is inputted is stored. Here, a value stored in the LUT 34 is predetermined according to characteristics of the pixel array 2. In the present embodiment, assume that if luminance of the pixel PIX (i,j) corresponds to a first gradation and a voltage corresponds to a second gradation is applied on the pixel PIX (i,j), then the pixel PIX (i,j) reaches luminance corresponding to a third gradation. At that time, the LUT 34 stores data indicative of the second gradation in accordance with the combination of the first gradation and the third gradation.

Further, in the present embodiment, in order to reduce storage capacity necessary for the LUT 34, video data D2 stored in the LUT 34 is limited to reached gradations corresponding to predetermined combinations of gradations, instead of reached gradations corresponding to all combinations of gradations. The modulation processing section 33 is provided with a calculation circuit 35 which interpolates video data D2 corresponding to the combinations stored in the LUT 34, and calculates and outputs video data D2 corresponding to an actually supplied combination of a previous frame representative value D0(i,j,k−1) and video data D(i,j,k).

For example, in the present embodiment, possible values of the previous frame representative value D0 and the video data D range from 0 to 255, respectively. As illustrated in FIG. 4, when an area specified by the previous frame representative value D0 and the video data D is divided into 8×8 areas, video data D2 corresponding to four corners of each area (9×9 points; combinations of two gradations each provided at an interval of 32 gradations) is stored in the LUT 34.

Further, if necessary, the modulation driving processing section 21 of the present embodiment stores, in the frame memory 31, a value other than the video data D (i,j,k). Note that, for convenience of explanation, data stored in the frame memory 31 is hereinafter referred to as a "representative value", regardless of whether video data is stored or other value is stored. To be more specific, a representative value to be stored in the frame memory 31 as video data D(i,j,k) of a current frame FR(k) to be supplied to a pixel PIX(i,j) or other value is referred to as Da(i,j,k), and a signal including representative values Da is referred to as a representative value signal DATa. Further, a value which is a representative value stored in the frame memory 31 and which is referred to by the modulation processing section 33 to correct video data D(i,j,k) of a current frame FR(k) is referred to as a previous frame representative value D0(i,j,k−1), and a signal including such representative values is referred to as a previous representative value signal DAT0. Note that, the previous frame representative value D0(i,j,k−1) is a representative value Da corresponding to a pixel PIX(i,j) to which the video data D(i,j,k) of the current frame FR(k) is supplied, and the previous representative value D0(i,j,k−1) is video data D(i,j,k−1) itself supplied as video data of a current frame in the previous frame FR(k−1) or data which was written in the frame memory 31 as a value replacing the video data D(i,j,k−1) and then stored in the frame memory 31 till the current frame FR(k).

The following explains a structure of the modulation driving processing section 21 in more detail. The modulation driving processing section 21 of the present embodiment includes a judgment section judgment means) 41 for judging whether or not to adopt video data D(i,j,k) of a current frame FR(k) as a representative value D1(i,j,k) corresponding to a pixel PIX(i,j) in a current frame FR(k), the judgment being performed based on video data D(i,j,k) of a current frame FR(k) and a previous frame representative value D0(i,j,k−1); and a representative value generating section 42 for, when the judgment section 41 judges that the video data D(i,j,k) is not to be adopted, storing in the frame memory 31 a representative value Da(i,j,k) calculated based on the previous frame representative value D0(i,j,k−1), instead of the video data D(i,j,k) of the current frame FR(k). Note that, a representative value Da(i,j,k) calculated based on the previous representative value D0(i,j,k−1) is hereinafter referred to as a "calculation value" so as to be discriminated from a representative value Da(i,j,k) which is video data Da(i,j,k) itself. The judgment section 41 and the representative value generating section 42 correspond to representative value generating means recited in the claims.

When the following inequality (1)

$$D(i,j,k)>\alpha\times D0(i,j,k-1) \quad (1)$$

where α is a predetermined constant, is satisfied, the judgment section 41 of the present embodiment judges that video data D(i,j,k) of a current frame FR(k) is to be adopted as a representative value Da(i,j,k), and when the inequality (1) is not satisfied, the judgment section 41 judges that the video data D(i,j,k) of the current frame FR(k) is not be adopted as a representative value Da(i,j,k). Here, α is set so as to satisfy a relation $0<\alpha<1$ in accordance with characteristics (optical response characteristics in particular) of the pixel array 2. How the judgment section 41 determines a value of α will be detailed later together with an explanation of how the judgment section 41 operates.

On the other hand, in line with a result of the judgment, the representative value generating section 42 of the present embodiment switches values to be supplied to the memory control circuit 32 as a representative value Da(i,j,k). Consequently, when the judgment section 41 judges that the video data D(i,j,k) of the current frame FR(k) is not be adopted as a representative value Da(i,j,k), the calculation value is stored in the frame memory 31.

To be more specific, the representative value generating section 42 includes a calculation section (calculation means) 51 for calculating a calculation value D1*a*(i,j,k) corresponding to a pixel PIX(i,j) in a current frame FR(k), based on a previous frame representative value D0(i,j,k−1); and a selection section 52 for selecting and outputting one of two data: a result of the calculation carried out by the calculation section 51; and video data D (i,j,k) of a current frame FR(k).

The calculation section 51 of the present embodiment calculates a calculation value D1*a*(i,j,k) based on the following equation (2)

$$D1a(i,j,k)=\beta\times D0(i,j,k-1) \quad (2)$$

where β is a predetermined constant. Here, β is set so as to satisfy a relation $0<\beta<1$ in accordance with characteristics (optical response characteristics in particular) of the pixel array 2. How to determine a value of β will be detailed later.

If input and output have the same value, then the representative value generating section 42 may be realized by causing a computer to execute a predetermined program, which will be detailed later. In the present embodiment, the calculation section 51 is realized by a multiplication circuit, and the selection section 52 is realized by a multiplexer (data selector).

In the above arrangement, while a gradation transition for greatly lowering a gradation (gradation transition for greatly decreasing luminance) is not performed, that is, while video data D (i,j,k) of a current frame FR(k) and video data D (i,j,k−1) of a previous frame FR(k−1) always satisfy the following inequality (3), $$D(i,j,k)>\alpha\times D(i,j,k-1) \quad (3)$$

the judgment section 41 judges that video data D(i,j,k) of a current frame FR(k) is to be a representative value Da(i,j,k). Therefore, the memory control circuit 32 writes the video data D (i,j,k) of the current frame FR(k) in the frame memory 31 and maintains the video data D(i,j,k) until a next frame FR(k+1).

As a result, in each frame FR(k), video data D(i,j,k−1) of a previous frame FR(k−1) is read from the frame memory 31 as a previous frame representative value D0(i,j,k−1). The modulation processing section 33 corrects the video data D(i,j,k) of the current frame FR(k) so as to emphasize a gradation transition from a gradation indicated by the video data D(i,j,k−1) of the previous frame FR(k−1) to a gradation indicated by the video data D(i,j,k) of the current frame FR(k), and the modulation processing section 33 outputs video data D2(i,j,k) obtained from the correction of the video data D(i,j,k). Consequently, a driving section 14 including the modulation driving processing section 21 can drive a pixel PIX(i,j) more speedily, so that it is possible to prevent deterioration in image quality due to a response delay at a time when moving images are displayed.

Figure 5:
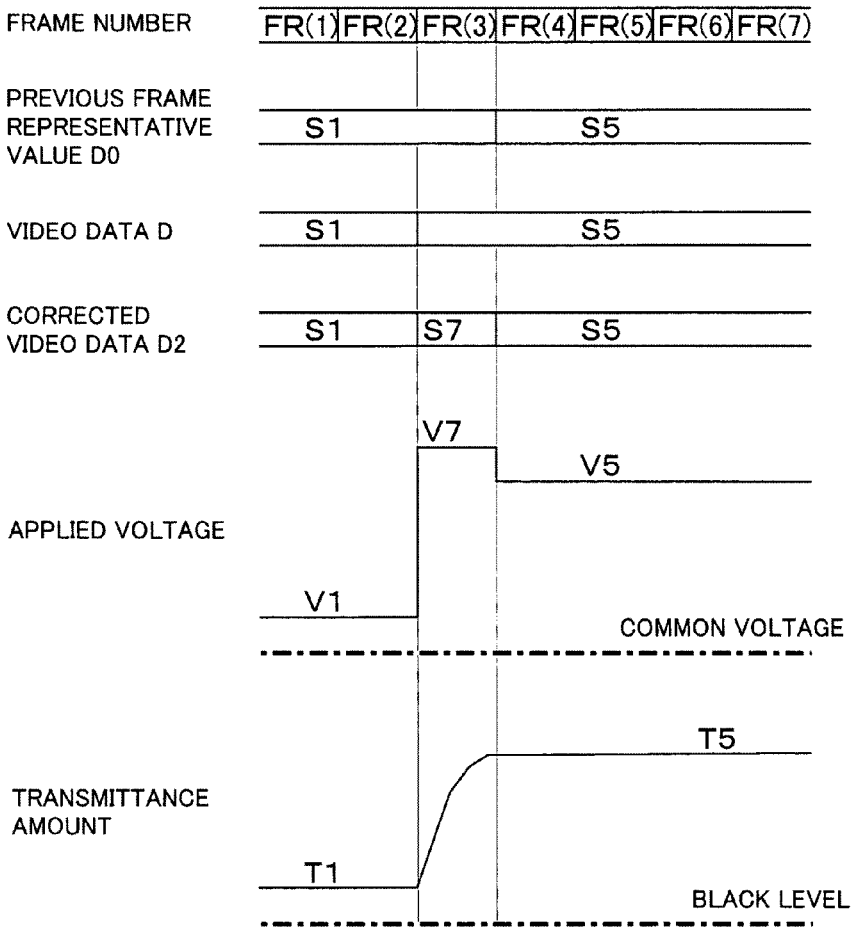
FIG. 5 is a timing chart illustrating operations of sections of the image display device in a case where video data of a current frame is stored as a representative value.

For example, as illustrated in FIG. 5, assume that S1, S1, S5, S5, S5, S5, and S5 are supplied to frames FR(1) to FR(7), respectively, as video data D(i,j,1) to D(i,j,7) to be supplied to a pixel PIX(i,j). Further, assume that the modulation processing section 33 is arranged so that if a previous frame representative value D0 is S1 and video data D of a current frame FR(k) is S5, then the modulation processing section 33 corrects the video data D so that S5 is replaced with S7 and outputs the corrected video data D. In this example, a gamma value of the video data D is 2.2. S0 indicates a black gradation and S255 indicates a white gradation. S indicates a larger gradation (luminance) as a value positioned after S gets larger.

At that time, in the frames FR(1) to FR(7), the modulation driving processing section 21 outputs S1, S1, S7, S5, S5, S5, and S5 as corrected video data D2(i,j,1) to D2(*i,j,*7), respectively. The driving section 14 outputs voltages V1, V1, V7, V5, V5, V5, and V5 corresponding to S1, S1, S7, S5, S5, S5, and S5, respectively.

Note that, in reality, (i) a time point when the video data D(i,j,3) is supplied to the modulation driving processing section 21, (ii) a time point when corrected video data D2(i,j,3) obtained by correcting the video data D(i,j,3) is supplied from the modulation driving processing section 21, and (iii) a time point when the data signal line driving circuit 3 applies a voltage corresponding to the corrected video data D2(i,j,3) on the pixel PIX (i,j) do not necessarily coincide with each other. However, in the present specification, for convenience of explanation, these data/voltage and luminance (transmittance) of the pixel PIX (i,j) which luminance (transmittance) is changed by application of the voltage are referred to as data of the frame FR(3), a voltage of the frame FR(3), and luminance (transmittance) of the frame FR(3), respectively, and in FIG. 5 and subsequent drawings, the data, the voltage, and the luminance are disposed longitudinally. Further, in the explanation of the luminance of the pixel PIX(i,j), a period from a time when a voltage of the frame FR(3) (V7 at this time) is applied to a time when a voltage of a next frame FR(4) (V5 at this time) is applied is referred to as a period of the frame FR(3). A change in luminance (gradation transition) of the pixel PIX(i,j) during the period is referred to as a change in luminance of the frame FR(3). The same reference also can be applied to any frame FR(k) other than the frame FR(3).

Figure 20:
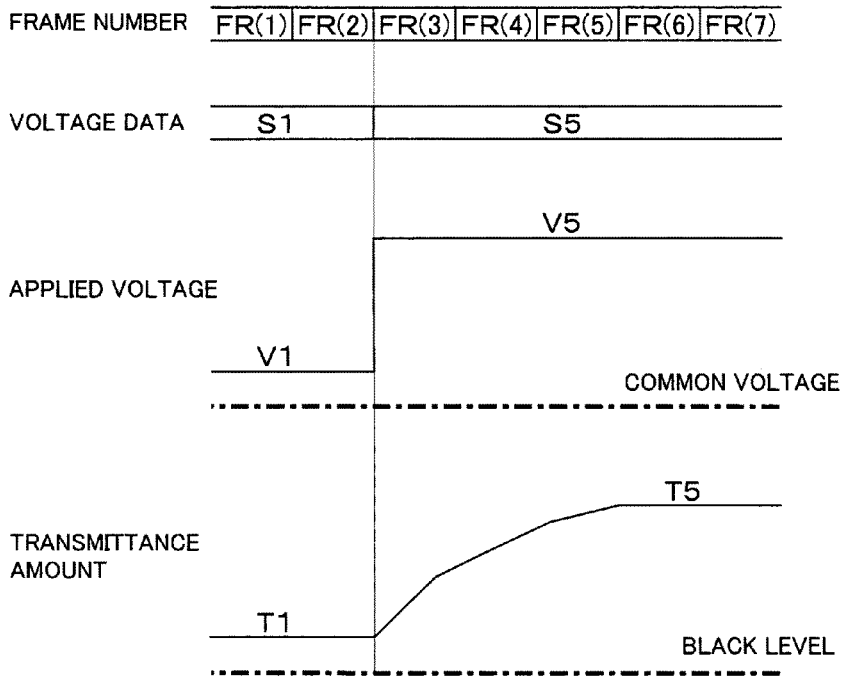
FIG. 20 is a timing chart of a conventional technique, illustrating an operation of an arrangement in which a gradation transition is not emphasized.
Figure 21:
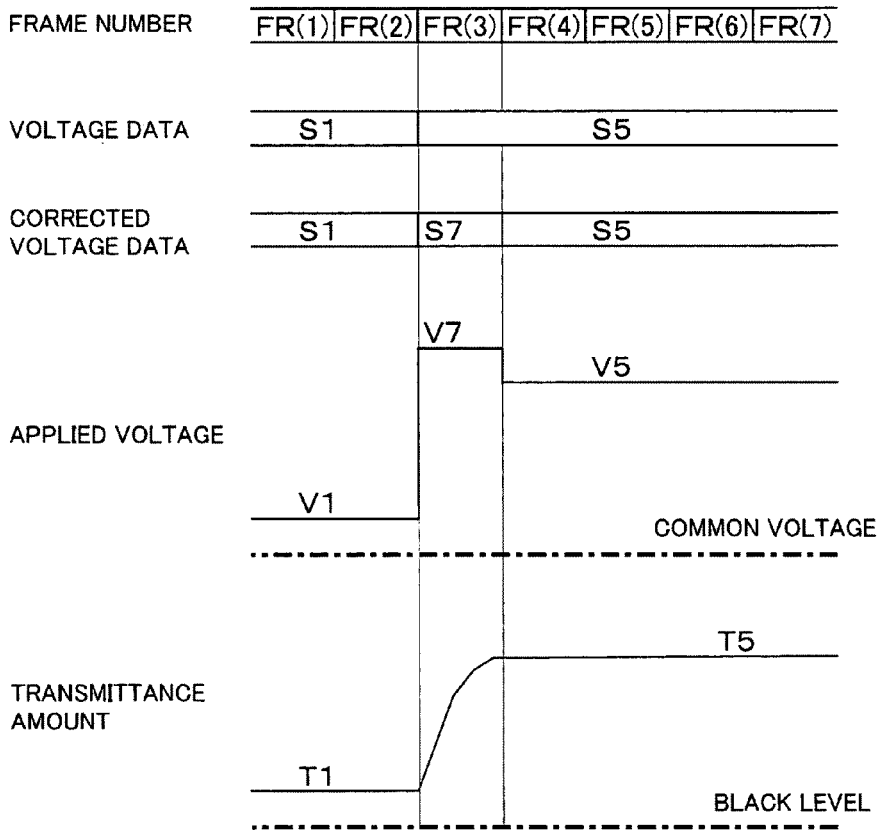
FIG. 21 is a timing chart of another conventional technique, illustrating an operation of an arrangement in which a gradation transition is emphasized.
Figure 22:
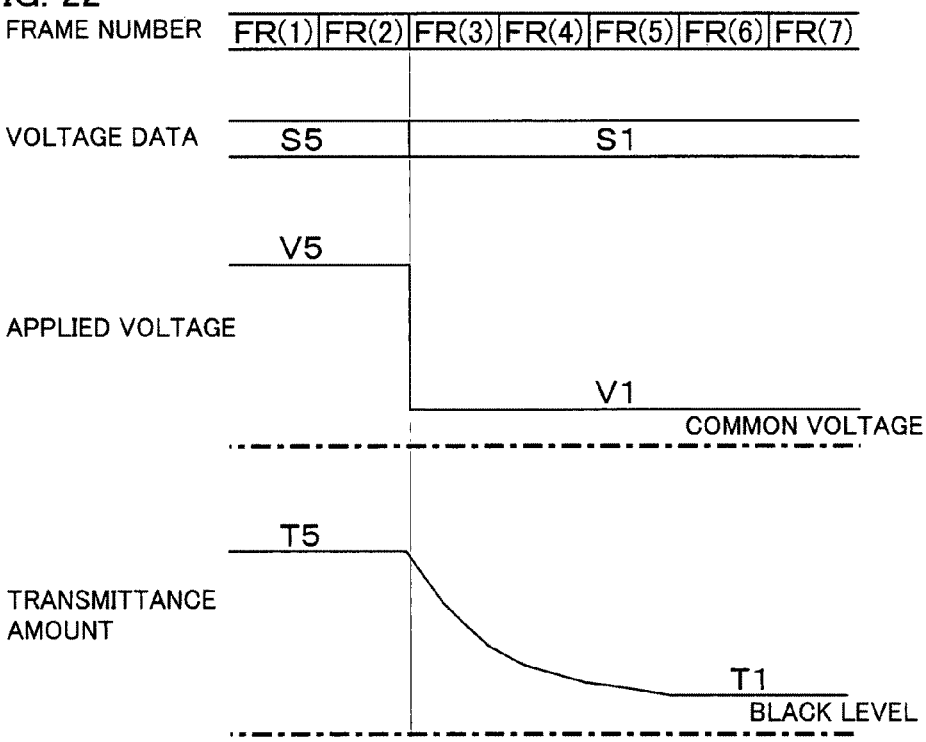
FIG. 22 is a timing chart of the conventional technique, illustrating operations of sections at a time when video data indicative of a gradation transition for decay is supplied.
Figure 23:
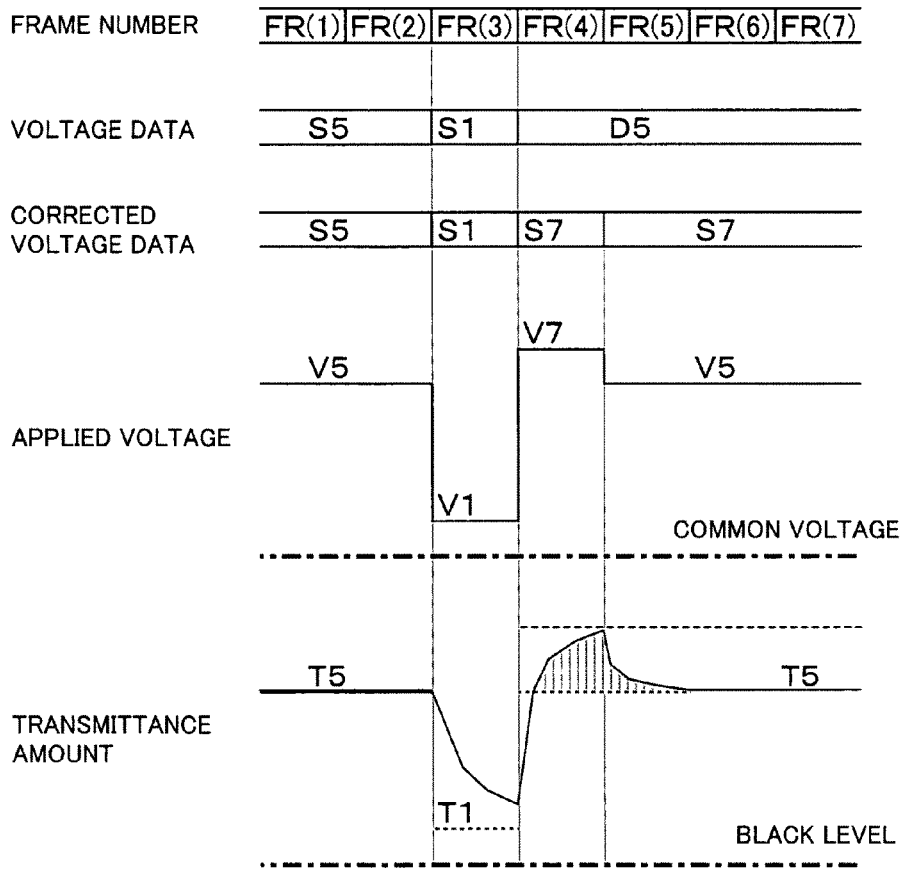
FIG. 23 is a timing chart of the conventional technique, illustrating operations of sections at a time when video data indicative of a gradation transition from decay to rise is supplied.

Here, the arrangement of FIG. 5 is compared with an arrangement similar to a conventional technique of FIG. 20 in which a modulation driving processing section does not correct video data D (i,j,k) and outputs the video data D (i,j,k) as it is. In the arrangement of FIG. 5, a voltage V7 higher than V5 is applied on a pixel PIX (i,j) in a frame FR(3). Therefore, transmittance of the pixel PIX (i,j) increases more rapidly compared with the arrangement of FIG. 20. Consequently, in the arrangement of FIG. 20, luminance indicated by the video data D(i,j,4) to D(i,j,7) (luminance T5 indicated by data S5) is not realized until frame FR(6) begins, whereas in the arrangement of FIG. 5, luminance (T5) indicated by the video data D(i,j,4) has been already realized when the frame FR(4) begins.

On the other hand, as described above, if a gradation transition for greatly lowering a gradation occurs after such a gradation transition does not occur, and if video data D(i,j,k−1) of a previous frame FR(k−1) and video data (i,j,k) of a current frame FR(k) do not satisfy the inequality (3), then the representative value generating section 42 causes, based on a result of judgment by the judgment section 41, a calculation value D1*a*(i,j,k) calculated based on the equation (2) to be written as a representative value D1(i,j,k) in the frame memory 31. Consequently, if β is set in accordance with characteristics of the pixel array 2, then it is possible to estimate luminance (gradation) which the pixel PIX(i,j) will reach according to the video data D(i,j,k), although calculation is performed based on a simple equation, that is, the equation (2) in which the previous frame representative value D0(i,j,k−1) is multiplied with the constant β. The estimation is performed with accuracy allowing for preventing deterioration in image quality due to gradation inversion and excess brightness. As a result, with a relatively small-scale circuit (alternatively, with a calculation process with a relatively small amount of calculation), it is possible to reduce deterioration in image quality due to gradation inversion and excess brightness.

To be more specific, if a representative value (previous frame representative value D0(i,j,k−1)) used in modulating video data D(i,j,k) allows for estimating with enough accuracy luminance of a pixel PIX(i,j) at a time when a signal corresponding to corrected video data D2(i,j,k) is applied on the pixel, that is, luminance of the pixel PIX(i,j) at a time when the previous frame FR(k−1) ends, then the modulation processing section 33 can modulate video data D(i,j,k) of a current frame FR(k) to an appropriate extent by referring to the previous frame representative value D0(i,j,k−1). Therefore, in this case, it is possible to prevent excessive emphasis or shortage of emphasis in modulation, so that it is possible to prevent deterioration in image quality in displaying moving images due to setting modulation to an inappropriate extent. However, if the estimation includes errors, then the modulation processing section 33 cannot perform modulation to an appropriate extent, although the modulation processing section 33 refers to an estimation value (previous frame representative value D0(i,j,k−1)). This results in deterioration in image quality in displaying moving images.

In a case where an estimation value (representative value D1(i,j,k)) instead of video data D(i,j,k) of a current frame FR(k) is stored in the frame memory 31 and a next estimation value is calculated by referring to the estimation value in a next frame FR(k+1), estimation including errors is accumulated. For that reason, in the arrangement in which a calculation value (estimation value) is always regarded as a representative value, calculation for estimation needs accuracy which allows for preventing the deterioration in image quality even if estimation errors are accumulated. Consequently, an amount of necessary calculation and a size of a circuit necessary for the calculation are relatively large.

On the other hand, in the driving section 14 of the present embodiment, in a case where the judgment section 41 judges that video data D(i,j,k) of a current frame FR(k) is a representative value, the video data D(i,j,k) is stored as a representative value D1(i,j,k) till a next frame FR(k+1), and video data D(i,j,k+1) to be supplied to a pixel PIX(i,j) is corrected referring to the video data D(i,j,k). Consequently, even if an error occurs while the calculation value D1*a*(i,j,k) is regarded as a representative value D1(i,j,k), the error is not accumulated. As a result, it is possible to allow accuracy in the calculation for estimation to be lower than the accuracy which allows for preventing the deterioration in image quality. Consequently, it is possible to downsize the amount of necessary calculation and the size of a circuit necessary for the calculation, compared with the arrangement in which estimation is always performed.

In particular, in the present embodiment, calculation value D1*a*(i,j,k) is calculated based on the equation (2), so that it is possible to effectively prevent the above phenomenon, that is, a phenomenon in which image quality is deteriorated because modulation is performed to the same extent as a case where response delay does not occur, while downsizing the amount of necessary calculation and the size of a circuit necessary for the calculation.

To be more specific, in a case where a gradation transition in a current frame FR(k) is such that a response of a pixel PIX (i,j) delays a little, luminance of the pixel PIX (i,j) at a time when the current frame FR(k) ends changes due to an influence not only from luminance of the pixel PIX(i,j) at a time when the current frame FR(k) begins but also from corrected video data D2(i,j,k).

In a transition which is expected to cause a greater response delay, luminance at a time when the current frame FR(k) begins influences more greatly on luminance at a time when the current frame FR(k) ends. Assume a situation in which: although video data D(i,j,k) is corrected to the limit of the pixel array 2 as a display device and the pixel array 2 is driven according to the corrected video data D2(i,j,k), response of the pixel PIX(i,j) delays too much (response of the pixel PIX (i,j) reaches the limit in the current frame FR(k)) and if modulation is performed in a frame FR(k+1) posterior to the frame FR(k) to the same extent as a case where response does not delay, then image quality in displaying moving images deteriorates greatly. In the situation, luminance at a time when the current frame FR(k) ends is influenced by neither corrected video data D2(i,j,k) of the current frame FR(k) nor video data D(i,j,k) of the current frame FR(k). Instead, the luminance is influenced by luminance at a time when the current frame FR(k) begins. Therefore, in this case, the representative value generating section 42 obtains the representative value D1(i,j,k) based on a previous frame representative value D0(i,j,k−1), allowing for estimating luminance at a time when a gradation transition ends, with a relatively high accuracy and a relatively small amount of calculation (alternatively, relatively small-scale circuit).

Consequently, it is possible to effectively prevent the above phenomenon, that is, a phenomenon in which image quality is deteriorated because modulation is performed to the same extent as a case where response delay does not occur, while downsizing the amount of necessary calculation and the size of a circuit necessary for the calculation.

Further, deterioration in image quality due to the limit of a response occurs both in a case where a gradation transition for greatly decreasing luminance is performed and then luminance is increased and in a case where a gradation transition for greatly increasing luminance is performed and then luminance is decreased. However, when a next gradation transition is emphasized to the same extent as a case where a response delay does not occur in a first gradation transition, luminance deteriorates undesirably and poor brightness occurs in the latter case, while luminance increases undesirably and excess brightness occurs in the former case. Excess brightness is more likely to be recognized by a user and therefore image quality deteriorates more greatly in a case where a response delay in a gradation transition for greatly decreasing luminance is not corrected. At a time when luminance decreases, a response speed is more likely to be limited as a ratio of video data D(i,j,k) of a current frame FR(k) to a previous frame representative value D0(i,j,k−1) is smaller. If the ratio is a predetermined value or more, then the response speed is not limited.

Therefore, the judgment section 41 judges whether the video data D(i,j,k) of the current frame FR(k) is to be regarded as a representative value D1(i,j,k) or not based on whether the inequality (1) is satisfied or not, thereby allowing to judge, with a relatively simple calculation and with relatively high accuracy, which is more likely to cause deterioration in image quality out of the case where the representative value D1(i,j,k) is calculated based on the equation (2) or the case where the video data D(i,j,k) of the current frame FR(k) is regarded as the representative value D1(i,j,k). Consequently, it is possible to effectively prevent the phenomenon while downsizing the amount of calculation necessary for the judgment and the size of a circuit necessary for the judgment.

The following further details a particularly preferable example in which a liquid crystal cell in vertical alignment mode and normally black mode is used as the pixel array 2.

First, the following explains why the liquid crystal cell is suitable to be driven by the modulation driving processing section 21.

In a liquid crystal display element in vertical alignment mode and normally black mode, liquid crystal molecules are substantially perpendicular to a substrate when no voltage is applied, and liquid crystal molecules are inclined from the substantially perpendicular state as a voltage is applied and the voltage reaches a certain threshold value. This allows for switching of the amount of transmittance.

Therefore, black display is provided when a voltage is near a threshold voltage, and white display is provided as a voltage is applied and light transmittance increases. Response characteristics of transmittance of the liquid crystal display element are such that a gradation transition from black display to halftone display is notably slower than other gradation transition. For example, the gradation transition may be performed over 3 frames to 6 frames. If a gradation transition is emphasized as described above in the liquid display element, then the gradation transition from black display to halftone display is greatly improved. It follows that a gradation transition is emphasized rather more greatly than desired halftone display.

Therefore, particularly in a gradation transition from a gradation near black to a halftone, actual display state of substantially black display influences the gradation transition, so that the gradation transition to a halftone is more likely to be emphasized to an inappropriate extent. Therefore, unless the degree of emphasizing a driving signal is controlled with comparative exactness, the degree of the emphasis increases more than necessary and excess brightness occurs or the degree of the emphasis decreases more than necessary and black image smearing occurs.

In consideration of display quality, some amount of poor brightness, black image smearing, and white image smearing are inevitable, although too much of them are problematic. On the other hand, excess brightness is very likely to be recognized and therefore it should not exist. For that reason, improvement in excess brightness is firstly desirable in improvement of deterioration in image quality due to inappropriate modulation. Improvement in excess brightness improves display quality more greatly than other improvement does.

Further, the liquid crystal cell is in normally black mode and therefore has not enough voltage for emphasizing a gradation transition to a black gradation, so that it is often that a black display response does not complete in accordance with a decrease in a response of a liquid crystal. Consequently, a gradation transition is emphasized too much, so that a gradation display brighter than a target halftone display is provided, resulting in excess brightness. As described above, vertical alignment mode and normally black mode tend to cause excess brightness for the above two reasons.

On the other hand, preventing excess brightness by using a look-up table or performing highly definite estimation calculation would increase the amount of necessary calculation or the size of a circuit. For that reason, causing video data D(i,j,k) to be corrected by the modulation driving processing section 21 including the judgment section 41 and the representative value generating section 42 would be very effective.

Here, before explaining the operation of the modulation driving processing section 21 of the present embodiment in more detail, the following explains, as a comparative example, an operation of a structure which is the same as the structure of FIG. 1 except that the judgment section 41 and the representative value generating section 42 are not provided.

Figure 6:
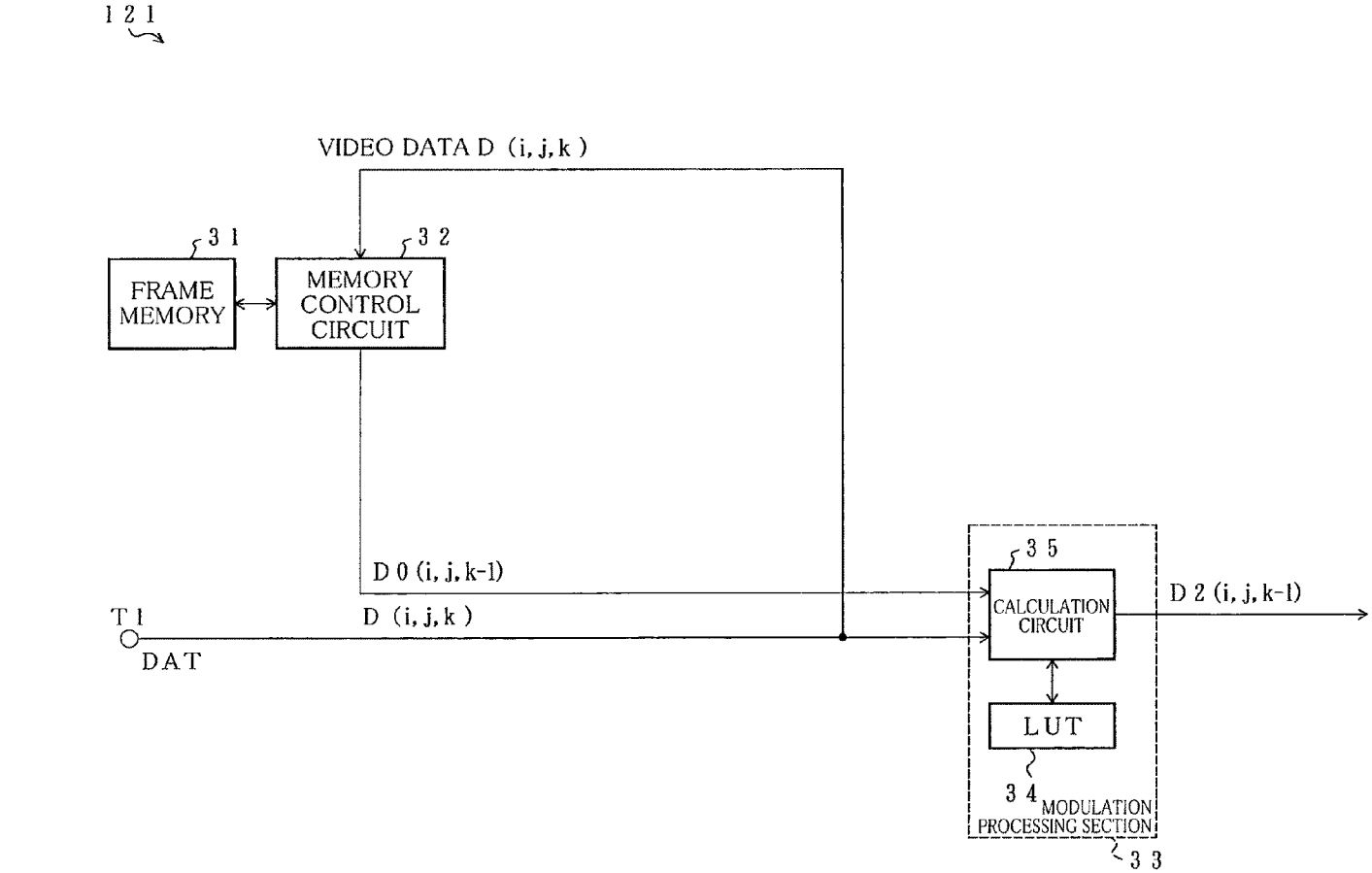
FIG. 6 is a block diagram of a comparative example, illustrating a main structure of a modulation driving processing section in which a judgment section and a representative value generating section are not provided.

As illustrated in FIG. 6, a modulation driving processing section 121 of the comparative example is not provided with the judgment section 41 and the representative value generating section 42. Consequently, regardless of a video signal DAT supplied to the modulation driving processing section 121, video data D(i,j,k−1) of a previous frame FR(k−1) is stored in a frame memory 31 and the modulation processing section 33 supplies video data D2(i,j,k) which is modulated so as to emphasize a gradation transition from a gradation indicated by the video data D(i,j,k−1) of the previous frame FR(k−1) to a gradation indicated by video data D(i,j,k) of a current frame FR(k) (gradation transition from the previous frame FR(k−1) to the current frame FR(k)).

In the arrangement, as illustrated in FIG. 5 for example, if a gradation transition from a previous frame FR(2) to a current frame FR(3) is a gradation transition whose degree is such that a pixel PIX(i,j) driven in response to video data D2(i,j,3) modulated by the modulation processing section 33 can respond within one frame, then the pixel PIX(i,j) can reach luminance (T5) indicated by the video data D(i,j,3) at the beginning of a next frame FR(4).

Figure 7:
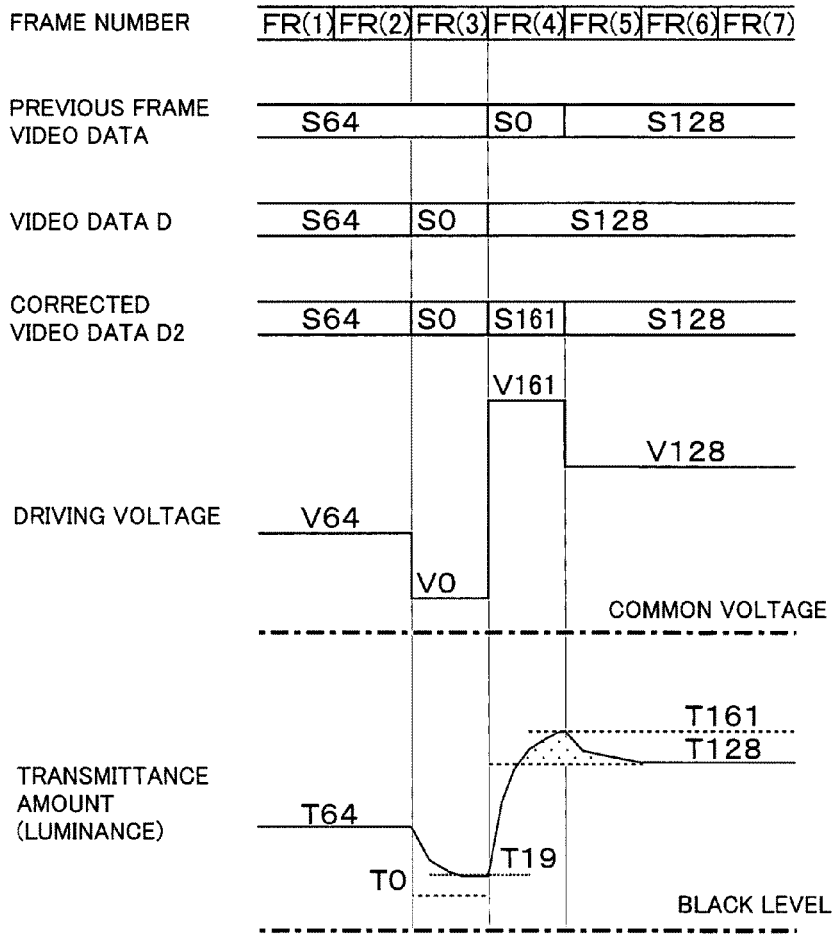
FIG. 7 is a timing chart illustrating operations of sections in the comparative example in a case where video data indicative of a gradation transition from decay to rise is supplied.

However, as illustrated in FIG. 7, if a gradation transition from a previous frame FR(2) to a current frame FR(3) is a gradation transition whose degree is such that a pixel PIX(i,j) driven in response to video data D2(i,j,3) modulated by the modulation processing section 33 cannot respond within one frame (in FIG. 7, a gradation transition from a gradation indicated by S64 to a gradation indicated by S0), then the pixel PIX(i,j) cannot reach luminance (T0) indicated by the video data D(i,j,3) at the beginning of a next frame FR(4). In FIG. 7, the pixel PIX (i,j) cannot reach desired luminance (T0), but reaches luminance (T19) higher than the luminance (T0) at the beginning of the frame FR(4).

As described above, if luminance at the beginning of a frame FR(4) does not reach luminance (T0) indicated by video data D(i,j,3) of the previous frame FR(3) because of a response delay of the pixel PIX (i,j) in the frame FR(3), and if the modulation driving processing section 21 generates corrected video data D2 (S161 in this example) of the frame FR(4) based on video data D (S0 in this example) of the previous frame FR(3) and video data D(S128 in this example) of the current frame FR(4) and applies a voltage (V161) corresponding to the video data D2, then there is a possibility that luminance of the pixel PIX (i,j) at the end of the frame FR(4) exceeds a desired value. In FIG. 7, luminance at the end of the frame FR(4) is luminance T161 higher than desired luminance T128.

Here, the following experiment was performed so as to confirm (i) a range of a gradation transition which causes response delay, (ii) a gradation to which the pixel PIX (i,j) can reach if the response delay is caused, and (iii) an influence of the response delay on moving images. A result of the experiment is as follows.

Figure 8:
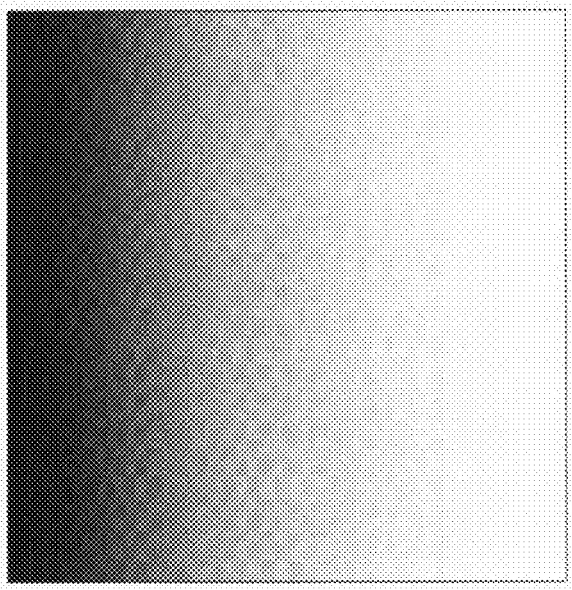
FIG. 8 is a drawing illustrating one (first image) of images alternately displayed on a pixel array in an experiment for confirming detailed operation in the comparative example.

The experiment was performed as follows. There was provided an image display device 101 which was substantially the same as the image display device 1 of the present embodiment except that the modulation driving processing section 121 in FIG. 6 was provided instead of the modulation driving processing section 21. FIG. 8 illustrates an image (first image) in which luminance gradually increases from a left portion to right portion of the image. The image was displayed as a still image, thereby stabilizing luminance of each pixel PIX in the pixel array 2.

Figure 9:
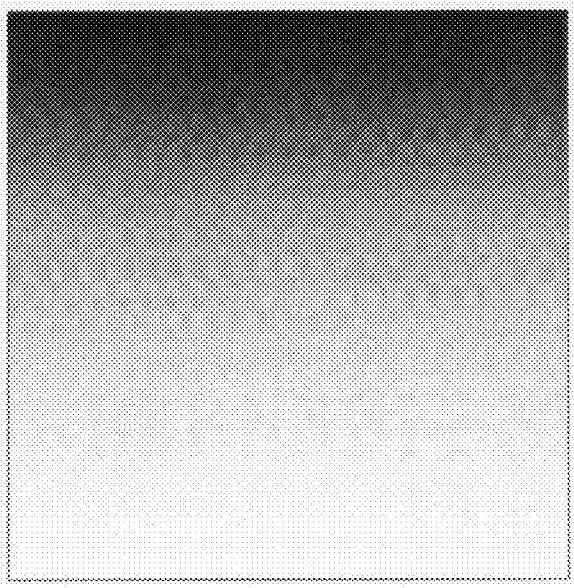
FIG. 9 is a drawing illustrating the other (second image) of the images alternately displayed on the pixel array in the experiment for confirming detailed operation in the comparative example.

Thereafter, while an image (second image) of FIG. 9 in which luminance gradually increases from an upper portion to a lower portion of the image and the image of FIG. 8 were alternately displayed, the luminance of each pixel PIX in the pixel array 2 was measured.

Figure 10:
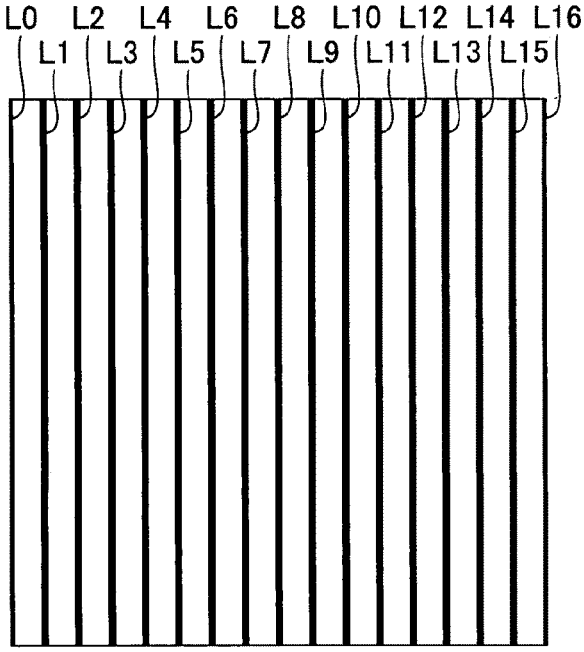
FIG. 10 is a drawing illustrating the first image by using contour lines.
Figure 11:
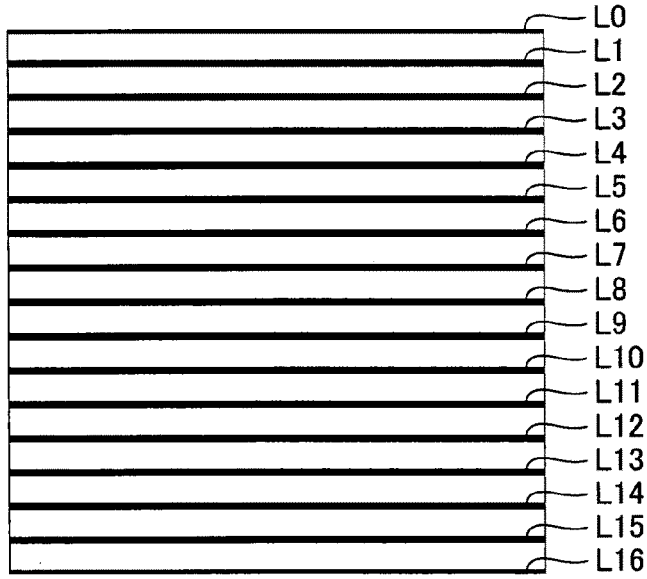
FIG. 11 is a drawing illustrating the second image by using contour lines.

FIGS. 10 and 11 illustrate distributions of luminance in the images of FIGS. 8 and 9 by using contour lines. The contour lines here are lines connecting points having an identical gradation (luminance) in each image. In the present embodiment, luminance of a pixel of each image is indicated by 256 gradations whose gamma value is 2.2. In FIGS. 10 and 11, contour lines are drawn with respect to each 16 gradations.

Here, assume that response delay of each pixel PIX does not occur. At that time, when the images are alternately displayed, luminance distribution of the pixel array 2 becomes distributions in FIGS. 10 and 11, respectively.

Figure 12:
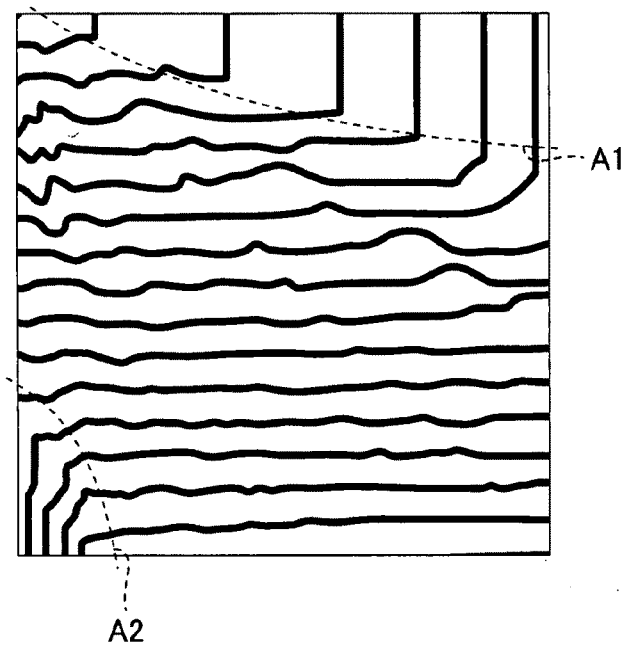
FIG. 12 is a drawing of a result of the experiment, illustrating by using contour lines an image displayed on an image display device in the comparative example at an end of a frame in which a still image display of the first image is switched to a display of the second image.
Figure 13:
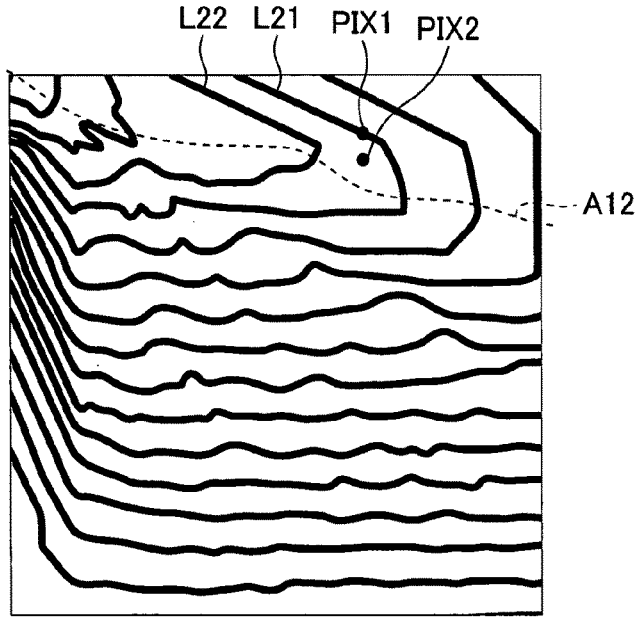
FIG. 13 is a drawing of a result of the experiment, illustrating by using contour lines an image displayed on the image display device in the comparative example at a time when a display switching between the first image and the second image is stabilized.

However, in reality, it was confirmed that an image illustrated in FIG. 12 was displayed by the pixel array 2 at the end of a frame in which the image of FIG. 8 as a still image was changed to the image of FIG. 9. Further, it was confirmed that an image illustrated in FIG. 13 was displayed in a state in which the images were alternately displayed and luminance of each pixel PIX of the pixel array 2 was stabilized. To be more specific, assuming that a frame in which the still image was changed to the image of FIG. 9 was referred to as a 1st frame and a frame in which the image of FIG. 9 was next changed to the image of FIG. 8 was referred to as a 2nd frame, FIG. 13 illustrates an image displayed by the pixel array 2 in a 59th frame. As with FIGS. 10 and 11, FIGS. 12 and 13 illustrate luminance distribution by using contour lines.

Here, it turned out from examination of FIG. 12 that luminance distribution in FIG. 12 was greatly different from correct luminance distribution (a state in FIG. 11) in terms of an area A1 positioned at the upper right part of a screen, and contour lines which should be in a lateral direction were bent above (in a direction in which pixels to display darker gradations are positioned). Further, it also proved that luminance distribution in FIG. 12 was a little different from the correct luminance distribution in terms of an area A2 positioned at the lower left part of the screen, and contour lines were bent below. Further, it turned out from further examination of the area A1 that a bent portion of each contour line is positioned so as to be substantially a straight line and the bend portion is substantially perpendicular to other portion of each contour line.

On the other hand, it turned out from examination of FIG. 13 that, in a state in which the images were alternately displayed and luminance of each pixel PIX of the pixel array 2 was stabilized, contour lines which should be in a lateral direction in an area A11 positioned at the upper right portion are bent at an angle of 90 degrees or more, and gradations were inverted. For example, a pixel PIX 2 is positioned below a pixel PIX 1 in FIG. 13, so that the pixel PIX 2 should display brighter luminance. However, the pixel PIX 2 is positioned between a contour line L21 passing through the pixel PIX 1 and a contour line L22 having darker luminance. In other words, the pixel PIX 2 has darker luminance than that of the pixel PIX 1, and a relation in size between gradations which the pixels PIX 1 and 2 are instructed to display is opposite to a relation in size between gradations which the pixels PIX 1 and 2 really display. Here, if gradation inversion occurs while moving images are displayed, then the images are perceived by a user as completely broken images, resulting in great deterioration image quality in displaying moving images.

Further, the above experiment was performed repeatedly, using pixel arrays 2 having different response speed of a pixel PIX, such as pixel arrays 2 having different physical properties of crystal liquid, different thickness of a liquid crystal layer, and different structure of a pixel electrode, and such as pixel arrays 2 in different temperatures. As a result of the experiment, it was confirmed that each pixel array 2 had a tendency in a 1st frame similar to that of FIG. 12.

To be specific, it was confirmed that (a) "although approximation lines of bent portions of contour lines incline at different angles, the bent portions are positioned so as to be substantially straight lines in an upper right area of a screen (area to greatly reduce luminance)", and (b) "the bent portions are substantially perpendicular". Item (b) indicates that, in the upper right area, luminance of a pixel PIX depends not on video data D(i,j,k) of a current frame FR(k) but on video data D(i,j,k−1) of a previous frame FR(k−1).

The arrangement of the modulation driving processing section 21 of the present embodiment is such that the constant a of the inequality (1) and the constant β of the equation (2) are set to values suitable for characteristics of the pixel array 2, and video data D(i,j,k) of a current frame FR(k) is regarded as a representative value D1(i,j,k) upon the inequality (1) being satisfied, and a calculation value D1*a*(i,j,k) calculated from the equation (2) is regarded as the representative value D1(i,j,k) upon the inequality (1) not being satisfied. The arrangement allows luminance of a pixel PIX(i,j) at the end of the current frame FR(k) to be estimated as the representative value D1(i,j,k) with enough accuracy, although comparatively simple calculation process is performed, that is, only multiplication and comparison are performed. Consequently, it is possible to prevent deterioration in image quality which is caused because: although the response delay really occurs in a previous frame, a gradation transition is emphasized to the same extent as a case where a response delay does not occur. Further, only multiplication and comparison are performed, so that it is possible to downsize a circuit, compared with a case where a representative value D1(i,j,k) is obtained referring to a look-up table.

Figure 14:
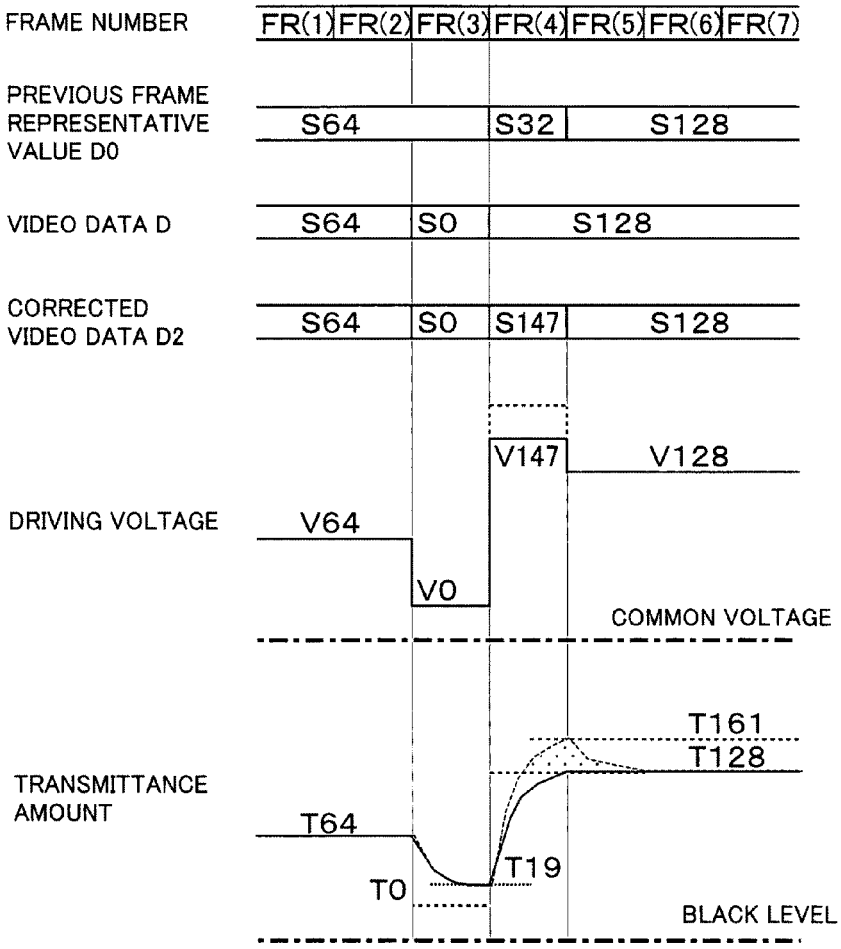
FIG. 14 is a timing chart illustrating operations of sections in the present embodiment at a time when video data indicative of a gradation transition from decay to rise is supplied.

For example, assume that data identical with that in FIG. 7 is supplied as video data D(i,j,1) to (i,j,7) to be supplied to a pixel PIX(i,j) in frames FR(1) to FR(7) as illustrated in FIG. 14. Further, assume that the modulation processing section 33 is set to correct video data D from S128 to S147 and output it when a previous frame representative value D0 is S19 and video data D of a current frame is S128. Further, assume that α and β suitable for characteristics of the pixel array 2 are set to be 0.5 and 0.5, respectively.

Here, if the inequality (3) has been satisfied until the frame FR(1) begins, then a previous frame representative value D0(i,j,1) which is compared with video data D(i,j,2) of a frame FR(2) is S64. At that time, in generating a representative value D1(i,j,3) of a frame FR(3), the judgment section 41 judges that the inequality (1) is not satisfied, and the representative value generating section 42 stores S19(=S64×0.3) as the representative value D1(i,j,3) in the frame memory 31.

Therefore, in generating corrected video data D2(i,j,4) of a next frame FR(4), the modulation processing section 33 corrects video data D(=S128) of the frame FR(4) while referring to the representative value D1(=S19) larger than video data D(=S0) of the frame FR(3). Consequently, the modulation driving processing section 21 outputs, as the correction video data D2(i,j,4), a value (S147) smaller than a value (S161) in FIG. 7, and a voltage (V147) corresponding to the value is applied on the pixel PIX (i,j). Therefore, luminance of the pixel PIX (i,j) increases more slowly than that in FIG. 7 and reaches to target luminance (T128).

Figure 15:
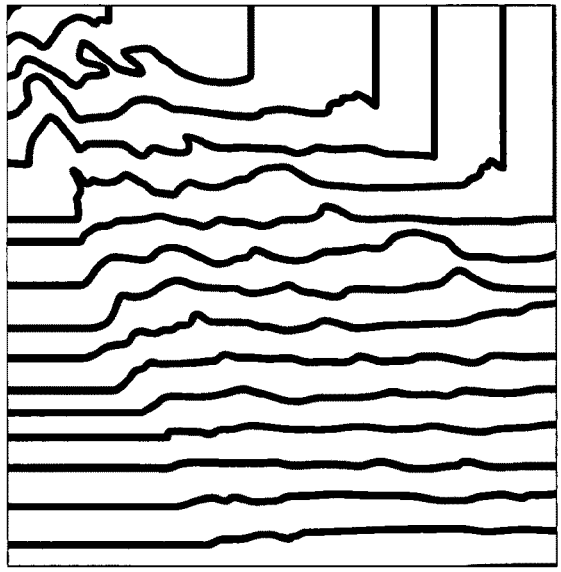
FIG. 15 is a drawing of a result of an experiment in the present embodiment, illustrating by using contour lines an image displayed on the image display device of the present embodiment at an end of a frame in which a still image display of the first image is switched to a display of the second image.

Further, in the image display device 1 including the modulation driving processing section 21 of the present embodiment, luminance of each pixel PIX of the pixel array 2 was measured in a case where the images in FIGS. 8 and 9 are alternately displayed with the same method as that in the above experiment. The result of the measurement is shown in FIG. 15. As with FIG. 13, FIG. 15 shows a state in which the images are alternately displayed and luminance of each pixel PIX is stabilized (59th frame).

As is evident from FIG. 15, it was confirmed that the modulation driving processing section 21 of the present embodiment greatly reduces gradation inversion, compared with the case of FIG. 13. In other words, it was confirmed that it is possible to prevent deterioration in image quality which is caused because: although the response delay really occurs in a previous frame, a gradation transition is emphasized to the same extent as a case where a response delay does not occur. This prevention allows for displaying moving images with high quality.

Figure 17:
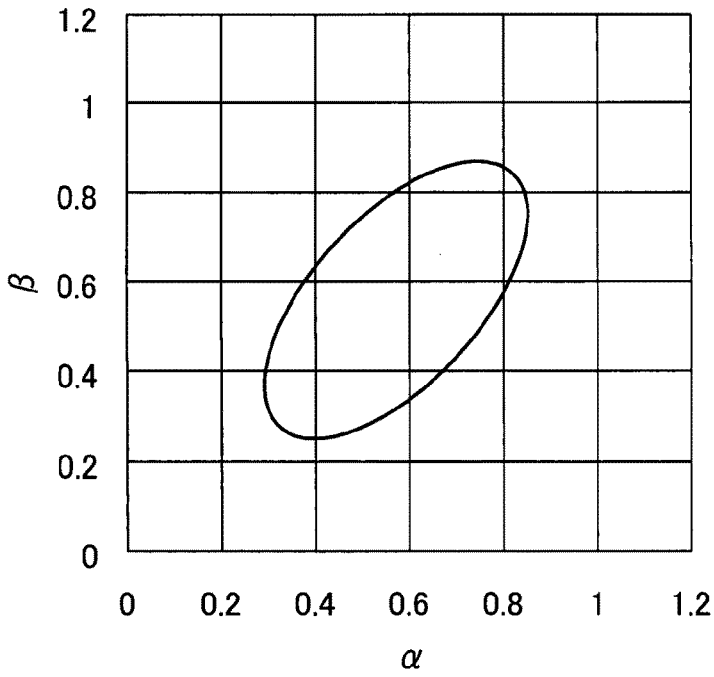
FIG. 17 is a graph showing a desirable range of the constants α and β used for the judgment and the calculation of a representative value in the image display device.

Further, with respect to the image display device 1 including the pixel array 2 including the pixels PIX whose response speed is different from each other, it was confirmed what numerical range is suitable for constants α and β. To be more specific, it was confirmed what numerical range prevents deterioration in image quality due to response delay of a pixel PIX from being perceived by a user, or what numerical range allows the deterioration to be considered by the user to be allowable. A result of the confirmation is illustrated in FIGS. 16 and 17.

To be specific, FIG. 16(*a*) illustrates a numerical range for α and β at which the user considered image quality to be allowable in a case where the image display device 1 using a liquid crystal cell in vertical alignment mode and normally black mode was under a condition that a temperature of the panel 11 was 40° C. In the same way, FIG. 16(*b*) illustrates a numerical range in a case where the image display device 1 was under a condition that the temperature of the panel 11 was 15° C. FIG. 16(*c*) illustrates a numerical range in a case where the image display device 1 was under a condition that the temperature of the panel 11 was 5° C.

From the drawings, the numerical range suitable for α and β proved to have the following characteristics 1 to 3.

1. (α, β) exists in an ellipse whose two foci exist near a point where α=β and whose ellipticity ranges approximately from 1.5 to 3.
2. The median point of the two foci ranges from (0.2, 0.2) to (0.6, 0.6).
3. The coordinate of a focus near (0, 0) out of two foci gets apart from (0, 0) as a temperature drops.

FIG. 17 illustrates a case where a numerical range suitable for the image display device 1 at 5° C. for example is indicated by an approximation ellipse whose ellipticity is approximately 2 and whose median point of foci is (0.6, 0.6).

Further, in setting α or β, if α or β is set so as to be indicated by m/2^n where m and n are integers being 0 or greater, then it is possible to reduce the amount of calculation (the size of a circuit). Further, in a case where the LUT 34 has a 9*9 table size including combinations of two gradations each provided at an interval of 32 gradations, if a response of each area can be separately controlled and m is an integer of 0 to 16 and n is 4, that is, if α or β is set so as to be represented by m/16, then it is possible to obtain an enough effect and to reduce the size of a circuit at the same time.

Further, the modulation driving processing section 21 of the present embodiment prevents "deterioration in image quality which is caused because a gradation transition is performed to the same extent as a case where a response delay of a pixel PIX(i,j) does not occur" by operating in the following manner, even if the modulation driving processing section 21 is instructed to alternately repeat decay and rise.

That is, in a case where the modulation driving processing section 21 is instructed to alternately repeat decay and rise, the frame memory 31 of the modulation driving processing section 21 stores in a frame FR(2) video data (i,j,1) of a one-previous frame FR(1).

For convenience of explanation, assume that video data D(i,j,1), (i,j,2), and (i,j,3) serially supplied in three continuous frames FR(1), FR(2), and FR(3) are indicated by C, B, and A, respectively, and a is set to k, and C>B and B<A. At that time, when B/C exceeds a predetermined threshold constant k and the A is identical with other A, the modulation driving processing section 21 corrects the A and outputs the corrected A, the correction being performed so that the corrected A becomes larger as the B gets smaller. In contrast, if B/C does not exceed the constant k and when the A is identical with other A, the modulation driving processing section 21 outputs a constant value as the corrected A, the constant value being predetermined based on the C regardless of the B. Note that, the "constant value being predetermined based on the C regardless of the B, when the A is identical with other A" is, in the case of FIG. 1, a value stored in the LUT as an output value in a gradation transition from C×β to A, or a value calculated as an output value in a gradation transition from C×β to A by referring to the LUT.

Here, as described above, the pixel array 2 has the characteristics of (a) "although approximation lines of bent portions of contour lines incline at different angles, the bent portions are positioned so as to be substantially straight lines in an upper right area of a screen (area to greatly reduce luminance)", and (b) "the bent portions are substantially perpendicular".

Even if the modulation driving processing section 21 is instructed to alternately repeat decay and rise, the modulation driving processing section 21 corrects A as described above, thereby preventing the deterioration in image quality.

The above explanation was made as to an arrangement in which: the modulation driving processing section 21 includes the judgment section 41 for judging whether the inequality (1) is satisfied or not and the representative value generating section 42 for storing in the frame memory 31 either a value calculated based on the equation (2) or video data D(i,j,k) of a current frame FR(k) according to a result of the judgment and the modulation driving processing section 21 performs the above operation if the modulation driving processing section 21 is instructed to alternately repeat decay and rise. However, the present invention is not limited to the arrangement. As long as the operation can be performed if instruction to alternately repeat decay and rise is given, the same effect can be obtained.

For example, the modulation driving processing section may be arranged so that it includes a frame memory capable of storing video data corresponding to two frames, and the modulation driving processing section performs the following operation [1], that is, an operation that "based on video data (C) of a two-previous frame and video data (B) of a one-previous frame each read from the frame memory and on current video data (A), when A>B, B/C exceeds a predetermined threshold constant k, and the A is identical with other A, the modulation driving processing section corrects the A and outputs the corrected A, the correction being performed so that the corrected A becomes larger as the B gets smaller, and when A>B, B/C does not exceed the constant k, and the A is identical with other A, the modulation driving processing section outputs a constant value as the corrected A, the constant value being predetermined based on C regardless of B". At that time, too, the modulation driving processing section can perform the operation if the modulation driving processing section is instructed to alternately repeat decay and rise. The modulation driving processing section having the arrangement may perform the operation [1] only when it is instructed to alternately repeat decay and rise or may always perform the operation [1].

Here, as described above, image quality greatly decreases when luminance increases after a gradation transition for greatly decreasing luminance and a response is limited in the gradation transition. Further, the response is more likely to be limited as a ratio of current video data to previous video data is smaller. If the ratio is a certain value or more, the response is not limited.

Therefore, in either case, the modulation driving processing section performs the operation [1], so that it is possible to effectively prevent deterioration in image quality while downsizing the amount calculation of necessary for calculation and judgment and the size of a circuit necessary for the calculation.

However, in the arrangement of FIG. 1, the representative value generating section 42 stores in the frame memory 31 a value calculated from the equation (2) or video data D(i,j,k) of a current frame FR(k), so that a memory capacity for a frame memory requires only a capacity corresponding to one frame. Therefore, it is possible to downsize the size of a circuit, compared with the arrangement in which a frame memory capable of storing video data corresponding to two frames is provided.

Embodiment 2

In Embodiment 1, an explanation was made as to a case where the constants α and β are fixed to values determined based on characteristics of the pixel array 2 (optical response characteristics in particular). In the present embodiment, an explanation will be made as to a case where the constants α and β are changed in accordance with a temperature change.

Figure 18:
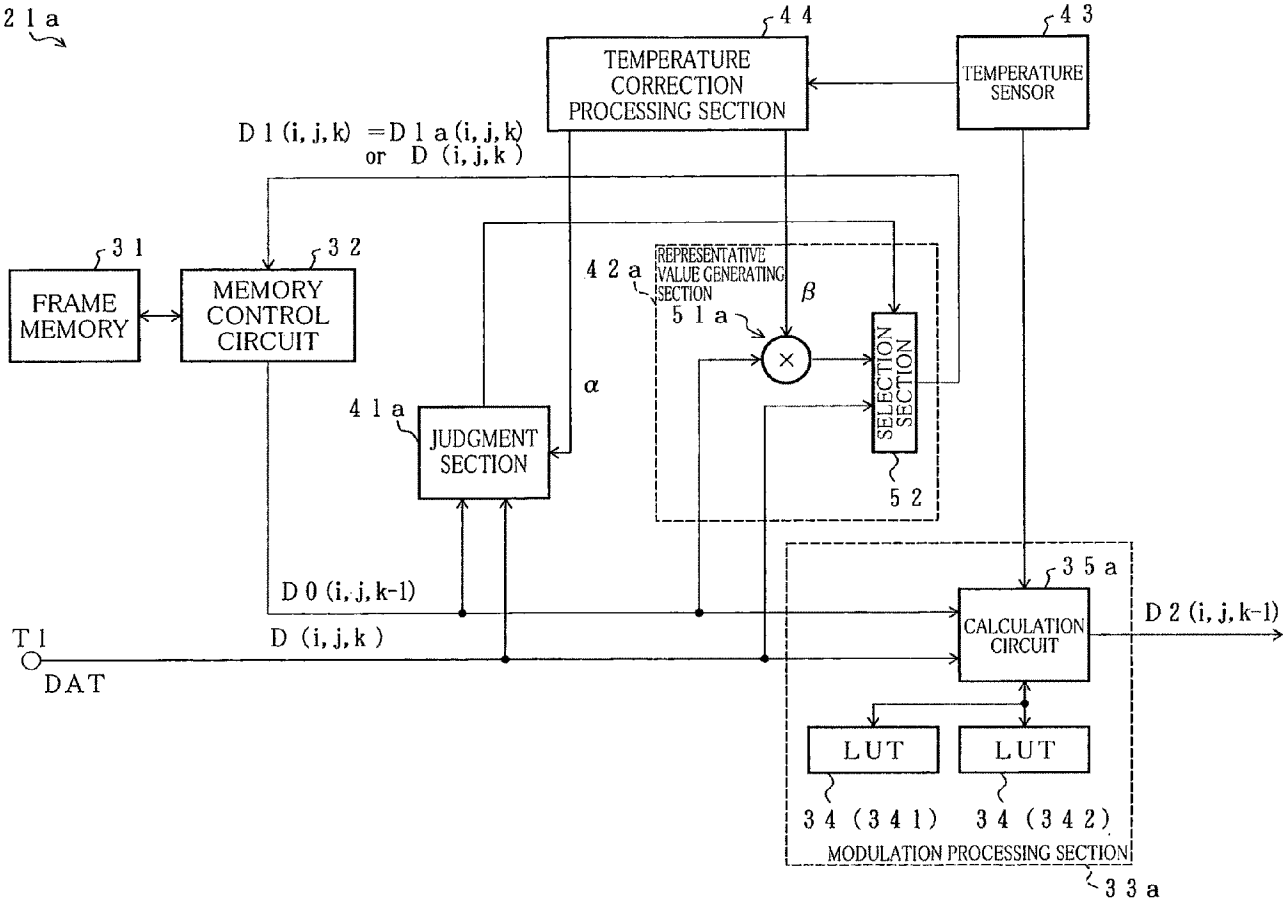
FIG. 18 is a block diagram of another embodiment of the present invention, illustrating a main structure of a modulation driving processing section of an image display device.

To be specific, an image display device 1*a* of the present embodiment is an image display device including the above liquid crystal cell as the pixel array 2. As illustrated in FIG. 18, in addition to the arrangement of FIG. 1, the modulation driving processing section 21*a* includes: a temperature sensor 43 for measuring a temperature of the panel 11 (panel temperature) including the pixel array 2; and a temperature correction processing section (temperature correcting means) 44 for changing, in accordance with a result of the measurement, a constant α which a judgment section 41*a* uses in judgment and for changing, in accordance with the result of the measurement, a constant β which a representative value generating section 42*a* uses in calculation.

The judgment section 41*a* and the representative value generating section 42*a* have substantially the same structures as the judgment section 41 and the representative value generating section 42 in FIG. 1, respectively, except that constants α and β are changed in accordance with instructions from the temperature correction processing section 44. To be more specific, the representative value generating section 42*a* includes a calculation section 51*a* instead of the calculation section 51. The calculation section 51*a* multiplies a previous frame representative value D0(i,j,k−1) to be supplied and a constant β specified by the temperature correction processing section 44, and outputs a result of the multiplication.

Further, the temperature correction processing section 44 is arranged so as to determine, based on a temperature measured by the temperature sensor 43, constants α and β suitable for the temperature. The temperature correction processing section 44 determines the suitable constants α and β based on a result of the measurement and supplies the constants α and β to the judgment section 41 and the representative value generating section 42. One example is such that the temperature correction processing section 44 stores constants α and β corresponding to each temperature range, and reads out constants α and β corresponding to a temperature range to which a result of measurement by the temperature sensor 43 belongs, and supplies the constants α and β. Another example is such that, a procedure (such as a calculation equation) for calculating constants α and β based on a temperature is predetermined, and the temperature correction processing section 44 calculates constants α and β, through the predetermined procedure, based on the result of the measurement.

Further, in the modulation driving processing section 21*a* of the present embodiment, the temperature correction processing section 44 changes constants α and β in accordance with a temperature, and a modulation processing section 33*a* changes a degree of gradation transition emphasis in accordance with the result of measurement by the temperature sensor 43.

To be specific, the modulation processing section 33*a* of the present embodiment has substantially the same arrangement as that of the modulation processing section 33 except that a plurality (two in this case) of LUTs 341 and 342 are provided as the LUT34. In each of the LUTs 341 and 342 is stored video data D2 which is to be supplied, in temperature ranges corresponding to the LUTs 341 and 342, respectively, by the modulation processing section 33*a*.

Further, a calculation circuit 35*a* has substantially the same arrangement as that of the calculation circuit 35 except that LUTs (341 and 342) to be referred to in interpolation calculation are switched in accordance with a result of measurement by the temperature sensor 43. This allows for changing the degree of gradation transition emphasis in accordance with the result of the measurement by the temperature sensor 43.

An example of another arrangement is such that the calculation circuit 35*a* reads out video data D2 from a plurality of LUTs (341 and 342) corresponding to the result of the measurement by the temperature sensor 43 and interpolates the video data D2 in accordance with the result of the measurement so as to calculate an LUT (alternatively, a part of an LUT) corresponding to the result of the measurement, and the calculation circuit 35*a* generates video data D2 based on the LUT (alternatively, a part of the LUT). This arrangement allows for more exact temperature correction, although the size of a circuit (alternatively, the amount of calculation) is a little larger than the arrangement in which LUTs are switched.

In general, a change in temperature causes a change in physical properties (such as viscosity) of a liquid crystal, so that response characteristics of a liquid crystal display element change in accordance with a temperature. Consequently, in a case such as the present embodiment in which a liquid crystal cell is used as the pixel array 2, response characteristics of a pixel PIX(i,j) change in accordance with a temperature. In particular, with a lower panel temperature, viscosity of a liquid crystal greatly increases. Consequently, response speed of the pixel PIX(i,j) greatly decreases, so that there is more frequently observed a situation in which a gradation transition of transmittance (luminance) does not complete in one frame (in the example of FIG. 12, the situation is observed in an area where bent portions of contour lines are displayed).

Therefore, optimal α and β and their numerical ranges vary in accordance with a temperature. At a certain temperature, α and β may be optimal, but at other temperature (such as a lower temperature), the α and β are not optimal. In a case where the α and β are not optimal, if deterioration in image quality is within a range allowed by a user, then it is possible to display moving images with enough high quality. However, in a case where a panel temperature drops greatly and response speed of the pixel PIX(i,j) drops greatly, if constants α and β are fixed as with Embodiment 1, then there is a possibility that image quality deteriorates out of the range allowed by the user.

On the other hand, in a driving section 14*a* including the modulation driving processing section 21*a* of the present embodiment, α and β are changed in accordance with a panel temperature. Consequently, in a wider range of a panel temperature and with higher accuracy than the arrangement in which constants α and β are fixed, it is possible to prevent the deterioration in image quality due to gradation transition emphasis performed to the same extent as a case where the response delay does not occur.

Further, in the modulation driving processing section 21*a* of the present embodiment, not only the constants α and β but also the degree of gradation transition emphasis by the modulation processing section 33*a* is changed in accordance with a panel temperature. Consequently, it is possible to continue to set the degree of gradation transition emphasis to a suitable value in a wider range of a panel temperature. Therefore, it is possible to increase image quality in displaying moving images in a wider range of a panel temperature.

Embodiment 3

In the present embodiment, an explanation will be made as to an arrangement in which settings of constants α and β can be externally changed. The arrangement of the present embodiment may be combined with either Embodiments 1 or 2. The following explains a case where the arrangement of the present embodiment is combined with Embodiment 1.

Figure 19:
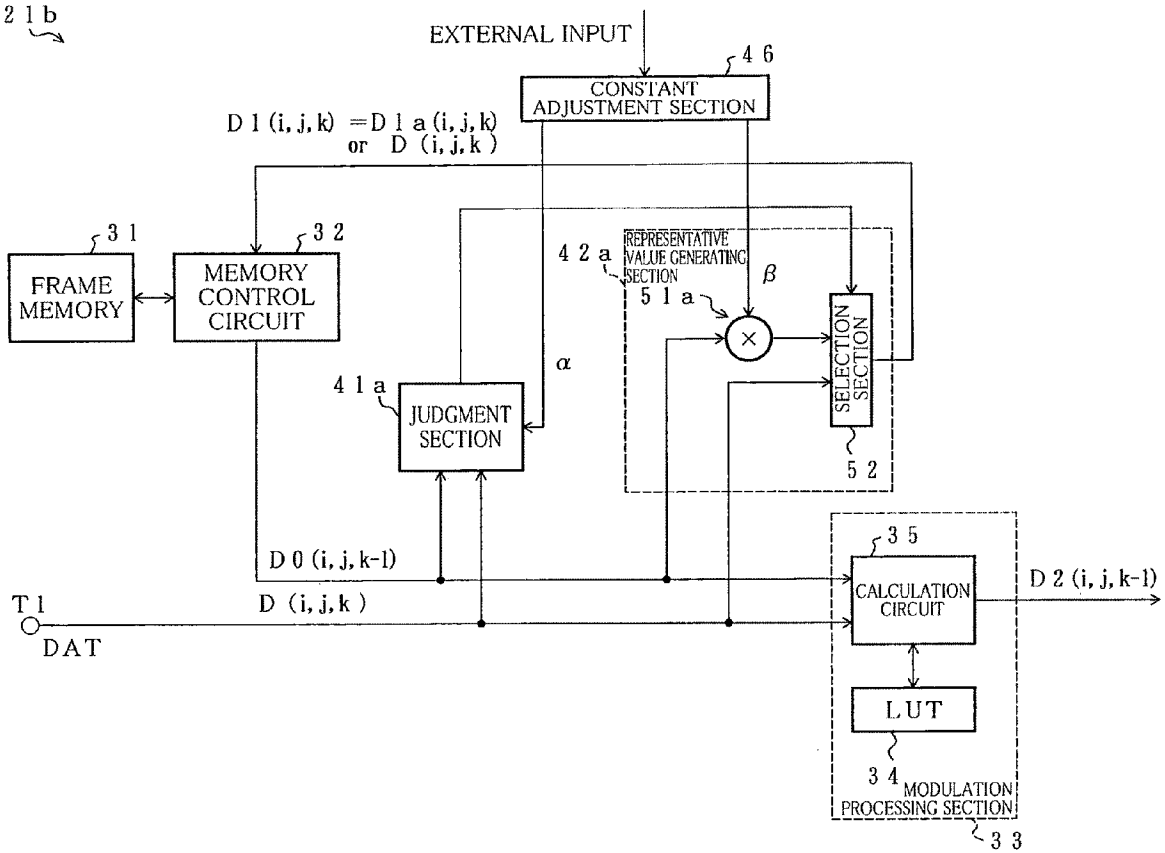
FIG. 19 is a block diagram of further anther embodiment of the present invention, illustrating a main structure of a modulation driving processing section of an image display device.

As illustrated in FIG. 19, a modulation driving processing section 21*b* of the present embodiment includes, in addition to the arrangement of FIG. 1, a constant adjustment section 46 for receiving an external input and for adjusting a constant α of a judgment section 41*a* and a constant β of a representative value generating section 42*a* in accordance with the external input. Further, as with Embodiment 2, in the present embodiment, instead of the judgment section 41 and the representative value generating section 42 in FIG. 1, there are provided the judgment section 41*a* and the representative value generating section 42*a* each capable of receiving instruction to change a constant α or β. Here, the external input may be, for example, an analog voltage signal or an analog current signal whose level corresponds to a constant α or β. In the present embodiment, a digital command signal indicating setting of a constant α or β is adopted. The constant adjustment section 46 changes, in accordance with the command signal, a constant α or β stored therein. The command signal may be a signal indicating a constant α or β itself or may be a signal indicating an increase/decrease of a constant α or β for example.

In a driving section 14*b* including the modulation driving processing section 21*b*, constants α and β can be adjusted in accordance with an external input, so that the constants α and β can be changed/set after the modulation driving processing section 21*b* has been fabricated. Consequently, it is possible to shorten a time for fabrication.

To be more specific, the pixel arrays 2 of the same type should have the same characteristics, but in reality they have individual differences due to unevenness in fabrication or other causes. Consequently, suitable α and β have unevenness. Note that, members other than the pixel array 2 such as a data signal line driving circuit 3 have individual differences, so that suitable α and β may have unevenness. If it is required to fabricate a modulation driving processing section 21*b* suitable for each of the members other than the modulation driving processing section 21*b* in an image display device after the members are fabricated, it is very troublesome and is not realistic.

On the other hand, in the modulation driving processing section 21*b*, constants α and β can be adjusted in response to an external input. Therefore, even if a modulation driving processing section 21*b* is fabricated so as to be common for each of the members, it is possible to set suitable constants α and β in accordance with individual difference among the members at a time point after the modulation driving processing section 21*b* has been fabricated (for example, at a time point before products are collected). Consequently, even if individual difference exists among the members, it is possible to fabricate, with smaller troublesomeness, the image display device 1*b* capable of preventing deterioration in image quality without any inconvenience.

Further, the present embodiment may be arranged so that the same type of modulation driving processing sections 21*b* are fabricated for different types of image display devices, and then the modulation driving processing sections 21*b* are set in accordance with the types and individual differences of the image display devices. At that time, common (the same type of) modulation driving processing sections 21*b* can be used for plural types of image display devices.

Further, the modulation driving processing section 21*b* may be arranged so that constants α and β may be changed in response to an instruction from a user of the image display device 1*b*. At that time, the constants α and β are set in accordance with the user's tastes, so that it is possible to display an image which is judged by the user to have higher display quality.

Note that, in the above embodiments, the representative value generating section (42 and 42*a*) outputs one of video data D(i,j,k) of a current frame FR(k) and a calculation value D1*a*(i,j,k) in response to judgment by the judgment section (41 and 41*a*). However, the present invention is not limited to these embodiments. As long as it is possible to store a calculation value D1*a*(i,j,k) instead of video data D(i,j,k) as a representative value D1(i,j,k) in the frame memory 31 when the judgment section judges that the calculation value D1*a*(i,j,k) is to be stored till a next frame, the same effect can be obtained by using other method for setting a representative value D1(i,j,k). An example of such other method is a method in which a representative value generating section changes video data D(i,j,k) stored in the frame memory 31 to a calculation value D1*a*(i,j,k) in accordance with the judgment.

Further, in the above embodiments, explanations were made as to a case where the operation for generating a representative value or the operation [1] for correcting a gradation A is basically always performed. However, the present invention is not limited to them. The present invention may be arranged so that: a gradation (C) in a two-previous frame and a gradation (A) in a current frame are compared, and only when a condition that both gradations are substantially the same with each other is satisfied, the operation [A] is performed.

The following explains a case where the operation [1] for correcting the gradation A is performed. In this case, when the condition is not satisfied, the modulation driving processing section performs a general gradation transition emphasis process in which, for example, A is corrected so that a gradation transition from B to A is emphasized. Further, whether gradations C and A are substantially the same or not can be determined, for example, based on whether |C−A| is a predetermined threshold value or less, substantially like a case where a modulation driving processing section judges whether video data is a still image or not and the judgment of a still image stops a gradation transition emphasis process.

To be specific, in a case where each of video data indicative of the gradations A to C is of 8 bits (256 gradations) for example, the threshold value is set to 16 gradations or less. For example, in a case where the threshold value is set to 16 gradations, if |C−A|≦16 gradations, then it is judged that C is substantially the same as A. Further preferably, in a case where each of the gradations A to C is one of 256 gradations, the threshold value is set to 4 gradations or less (e.g. 4 gradations). For example, in a case where the threshold value is set to 4 gradations, if |C−A|≦4 gradations, then it is judged that C is substantially the same as A.

The following shortly explains an arrangement in which if a modulation driving processing section judges video data to be a still image, then the modulation driving processing section stops a gradation transition emphasis process. In actual image display, various noises (noises overlapped in a signal transmission system) are overlapped with a video signal. Consequently, even in displaying a still image, video data to be supplied to each pixel changes with time in the video signal. For that reason, if a gradation transition emphasis process is performed at that time, then noises themselves are emphasized, and therefore there is a possibility that the emphasized noises cause a sandy image to be displayed. In contrast, assume an arrangement in which the modulation driving processing section compares previous video data and current video data and if a difference between the two data has a predetermined threshold value or less, then the modulation driving processing section judges the video data to be a still image and stops a gradation transition emphasis process and outputs the video data as it is (without correcting the video data). In this arrangement, the gradation transition emphasis process is stopped when a still image is inputted. This allows for preventing the above inconvenience.

Here, in order to realize a special effect in displaying moving images, there is a case where a control is performed so that a relation C≈A is frequently satisfied (so that a situation C≈A is realized). For example, there is a case where two gradations A and B are repeatedly switched with respect to each frame (alternatively, with respect to each field as mentioned later) and are averaged in time so as to display a complex gradation. Further, there is a case where the same luminance is displayed by different combinations of gradations so as to change texture.

Such expression techniques are used in driving pixels by dividing one frame into a plurality of fields (alternatively, sub-frames). At that time, an image signal supplied to the modulation driving processing section 21 is an image signal in each field (alternatively, in each sub-frame). Therefore, a field memory for storing video data corresponding to one field may be provided instead of the frame memory 31.

Such expression techniques are premised on that luminance of each pixel in a gradation transition changes in a predetermined range. For that reason, if the luminance of each pixel changes out of the predetermined range, then excess brightness occurs and an image completely different from what is desired in the special effect is obtained. Consequently, there is a possibility that whole images are greatly impaired.

For example, assume a case where a gradation transition from gradations A to B has a certain threshold value and response of pixels delays and therefore the gradation transition from B to A is emphasized to an inappropriate extent. At that time, a bright gradation completely different from a gradation intended in the special effect is expressed, as well as excess brightness occurs, resulting in shift of luminance.

On the other hand, with the arrangement, if a gradation (C) of a two-previous frame and a gradation (A) of a current frame are substantially the same as each other, then it is possible to perform a mild and substantially constant gradation transition provided that $B<k \cdot A$, so that it is possible to prevent deterioration in image quality. Consequently, it is possible to prevent excess brightness and undesired image effect (such as shift of luminance), so that it is possible to obtain a desired special effect.

In the embodiments, explanations were made as to a case where members constituting a modulation driving processing section are realized entirely by means of hardware. Alternatively, the members may be realized entirely or partly by a combination of a computer program providing the aforementioned functions and hardware (computer) executing the program. An example of such a modulation driving processing section (21 to 21*b*) is a computer being connected to an image display device 1 to act as a device driver driving the image display device. In addition, if the modulation driving processing section can be realized as an built-in or external conversion board to the image display device 1, and the operation of a circuit providing the modulation driving processing section is alterable by rewriting firmware or another computer program, the software may be distributed by distributing a storage medium which stores the software or transmitting the software via transmission path so that the hardware executes the software and functions as the modulation driving processing section of the embodiments.

In these cases, if hardware capable of executing the aforementioned functions is prepared, the modulation driving processing section in accordance with the embodiments can be realized simply by having the hardware execute the computer program.

To be specific, in the case of realizing the modulation driving processing section by software, the modulation driving processing section 21 to 21*b* in accordance with the embodiments can be realized by having CPU or computing means including hardware capable of executing the above function execute a program code stored in a ROM, RAM, or other storage medium, and control a marginal circuit (not shown) such as an input/output circuit.

At that time, the modulation driving processing section can be realized by a combination of hardware carrying out some of the processes and the computing means controlling the hardware and executing program code for the other processes. Further, those members which were described as hardware may be realized by a combination of hardware carrying out some of the processes and the computing means controlling the hardware and executing program code for the other processes. The computing means may be a single entity, or a set of computing means connected over internal device bus and various communications paths may work together to execute program code.

The program code itself directly executable by the computing means or the program as data that can generate program code by decompression or an other process (detailed later) is executed by the computing means after the program (program code or the data) is recorded and distributed on a storage medium or the program is transmitted and distributed over communications means which transmits the program over wired or wireless communications paths.

To transmit over a communications path, a program is transmitted though the communications path by means of a series of signals indicative of a program which propagate through the transmission media constituting the communications path. To transmit a series of signals, a transmitter device may modulate a carrier wave with the series of signals indicative of the program to transmit the series of signals on the carrier wave. In this case, a receiver device will restore the series of signals by demodulating the carrier wave. Meanwhile, when transmitting the series of signals, the transmitter device may divide the series of signals as a series of digital data into packets for a transmission. In this case, the receiver device will combine received group of packets to restore the series of signals. In addition, the transmitter device may transmit the series of signals by time division, frequency division, code division, or another multiplex scheme involving the series of signals and another series of signals. When this is the case, the receiver device will extract individual series of signals from a multiplex series of signals to restore them. In any case, similar effects are obtained if the program can be transmitted over a communications path.

Here, the storage medium for the distribution of a program is preferably removable. After the distribution of the program, the storage medium may or may not be removable. In addition, the storage medium may or may not be rewritable (writable) or volatile, be recordable by any method, and come in any shape at all, provided that the medium can hold the program. Examples of such a storage medium include tapes, such as magnetism tapes and cassette tapes; magnetic disks, such as floppy (registered trademark) disks and hard disks; and other discs, such as CD-ROMs, magneto-optical discs (MOs), mini discs (MDs), and digital video discs (DVDs). In addition, the storage medium may be a card, such as an IC card or an optical card; a semiconductor memory, such as a mask ROM, an EPROM, an EEPROM, or a flash ROM; or a memory provided inside a CPU or other computing means.

The program code may be such that it instructs the computing means regarding all the procedures of the processes. If there is already a basic computer program (for example, an operating system or library) which can be retrieved by a predetermined procedure to execute all or some of the processes, code or a pointer which instructs the computing means to retrieve that basic computer program can replace all or some of the processes.

In addition, the program storage format of the storage medium may be, for example, such that: the computing means can access the program for an execution as in an actual memory having loaded the program; the program is not loaded into an actual memory, but installed in a local storage medium (for example, an actual memory or hard disk) always accessible to the computing means; or the program is stored before installing in a local storage medium from a network or a mobile storage medium. In addition, the program is not limited to compiled object code. The program may be stored as source code or intermediate code generated in the course of interpretation or compilation. In any case, similar effects are obtained regardless of the format in which the storage medium stores the program, provided that decompression of compressed information, decoding of encoded information, interpretation, compilation, links, or loading to a memory or combinations of these processes can convert into a format executable by the computing means.

INDUSTRIAL APPLICABILITY

The present invention allows for, with a relatively small-scale circuit (alternatively, a relatively small amount of calculation), increasing response speed of a pixel and for preventing deterioration in image quality due to modulation performed to the same extent as a case where the response delay does not occur. Therefore, the present invention is preferably applicable to various display devices including TV receivers and liquid crystal monitors, and to driving of various display devices.

The invention claimed is:

1. A display control method, comprising the steps of:

(I) determining a representative value for correcting sets of video data serially supplied to a pixel of a display device, the determining being performed with respect to each of the sets of video data;

(II) storing the representative value till a next determining is performed; and (III) modulating current video data by referring to a previous representative value stored in the step (II), the modulating being performed so that a change from the previous representative value to the current video data is emphasized, the step (I) including the sub-steps of:

(i) judging whether the current video data is to be regarded as a representative value or not, by comparing the previous representative value stored in the step (II) and the current video data, and (ii) when it is judged that the current video data is not to be regarded as a representative value in the sub-step (i), calculating a representative value, through a predetermined procedure, based on at least the previous represeniative value out of the current video data and the previous representative value.

2. The display control method as set forth in claim 1, wherein

D1 is calculated in the sub-step (ii) based on an equation D1=D0 (n−1)×β, where D0(n−1) indicates the previous representative value, D(n) indicates the current video data, D1 indicates a representative value calculated when the judgment means compares D(n) with D0(n−1) and judges that D(n) is not to be regarded as a representative value, and β indicates a predetermined constant of more than 0 and less than 1, and it is judged in the sub-step (i) whether the current video data is to be regarded as a representative value or not based on whether an inequality D(n)>a×DO(n−1) is satisfied or not, where D0(n−1) indicates the previous representative value, D(n) indicates the current video data, and a indicates a predetermined constant of more than 0 and less than 1.

3. A display control method, comprising the step of:

when sets of video data serially supplied to a pixel of a display device indicate that luminance of the pixel rises and decays repeatedly and gradations indicated by serially supplied video data out of the sets of video data are indicated by C, B, and A in an order of supply where C>B, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

4. A display control method, comprising the step of:

when gradations indicated by sets of video data serially supplied to a pixel of a display device are indicated by C, B, and A in an order of supply, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

5. A driving device for a display device, comprising:

representative value generating means for determining a representative value for correcting sets of video data serially supplied to a pixel of the display device, the determining being performed with respect to each of the sets of video data;

representative value storage means in which the representative value is stored till a next determining is performed; and modulation means for modulating current video data by referring to a previous representative value stored in the representative value storage means, the modulating being performed so that a change from the previous representative value to the current video data is emphasized, the representative value generating means including:

judgment means for judging whether the current video data is to be regarded as a representative value or not, by comparing the previous representative value stored in the representative value storage means and the current video data; and calculation means for, when the judgment means judges that the current video data is not to be regarded as a representative value, calculating the representative value, through a predetermined procedure, based on at least the previous representative value out of the current video data and the previous representative value.

6. The driving device as set forth in claim 5, wherein the calculation means calculates the representative value based on the previous representative value.

7. The driving device as set forth in claim 6, wherein the calculation means calculates D1 based on an equation D1=D0(n−1)×β, where D0(n−1) indicates the previous representative value, D(n) indicates the current video data, D1 indicates a representative value calculated when the judgment means compares D(n) and D0(n−1) and judges that D(n) is not to be regarded as a representative value, and β indicates a predetermined constant of more than 0 and less than 1.

8. The driving device as set forth in claim 7, wherein the judgment means judges whether the current video data is. to be regarded as a representative value or not based on whether an inequality D(n)>α×D0(n−1) is satisfied or not, where D0(n−1) indicates the previous representative value, D(n) indicates the current video data, and a indicates a predetermined constant of more than 0 and less than 1.

9. A driving device for a display device, comprising correcting means for:

when sets of video data serially supplied to a pixel of the display device indicate that luminance of the pixel rises and decays repeatedly and gradations indicated by serially supplied video data out of the sets of video data are indicated by C, B, and A in an order of supply where C>B, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

10. A driving device for a display device, comprising correcting means for:

when gradations indicated by sets of video data serially supplied to a pixel of the display device are indicated by C, B, and A in an order of supply, (i) correcting A and outputting the corrected A when B/C is larger than a predetermined threshold constant k of more than 0 and less than 1 and when the A is identical with other A, the correcting being performed so that the corrected A is larger as the B is smaller, and (ii) outputting a constant value as the corrected A when B/C is not larger than the constant k and when the A is identical with other A, the constant value being predetermined based on the C regardless of the B.

11. The driving device as set forth in claim 7, further comprising temperature correcting means for adjusting the constant in accordance with a temperature.

12. The driving device as set forth in claim 7, further comprising adjustment means for adjusting the constant in response to an adjustment instruction which is externally given.

13. The driving device as set forth in claim 5, wherein the modulation means includes at least one look- up table in which a parameter corresponding to a combination of a value supplied as the previous representative value and a value supplied as the current video data is stored in advance, and the modulation means generates modulated current video data by referring to said at least one look-up table.

14. The driving device as set forth in claim 13, wherein said at least one look-up table includes a plurality of look-up tables, and the modulation means switches, in accordance with a temperature, the plurality of look-up tables to be referred to in generating the modulated current video data.

15. A display device, comprising a driving device as set forth in claim 5.

16. The display device as set forth in claim 15, further comprising, as a display element, a liquid crystal display element in vertical alignment mode and in normally black mode.

17. The display device as set forth in claim 15, said display device being a TV receiver which uses a liquid crystal display element as a display element.

18. The display device as set forth in claim 15, said display device being a liquid crystal monitor.

19. A computer-readable medium storing a program, when run on a computer, is configured to instruct the computer to function as each means of a driving device as set forth in claim 5.

* * * * *